US009765510B2

(12) United States Patent
Miller

(10) Patent No.: US 9,765,510 B2
(45) **Date of Patent: *Sep. 19, 2017**

(54) STRUCTURAL WALL PANELS FOR USE IN LIGHT-FRAME CONSTRUCTION AND METHODS OF CONSTRUCTION EMPLOYING STRUCTURAL WALL PANELS

(71) Applicant: Convergent Market Research, Inc., Austin, TX (US)

(72) Inventor: Clark Isaac Miller, Buda, TX (US)

(73) Assignee: Convergent Market Research, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/673,855

(22) Filed: Mar. 30, 2015

(65) Prior Publication Data

US 2015/0204068 A1 Jul. 23, 2015

Related U.S. Application Data

(63) Continuation of application No. 14/065,288, filed on Oct. 28, 2013, now Pat. No. 8,997,424.

(60) Provisional application No. 61/796,410, filed on Nov. 9, 2012, provisional application No. 61/795,872, filed on Oct. 27, 2012.

(51) Int. Cl.

| | |
|---|---|
| ***E04C 2/34*** | (2006.01) |
| ***E04B 1/08*** | (2006.01) |
| ***E04C 2/38*** | (2006.01) |

(52) U.S. Cl.

CPC ..... *E04B 1/08* (2013.01); *E04C 2/384* (2013.01); *E04C 2002/3488* (2013.01)

(58) Field of Classification Search

CPC . E04B 2/56; E04B 2/7457; E04B 2/58; E04B 2/789; E04C 2/36; E04C 2002/3488; E04C 2/384; E04C 3/07; E04C 2003/0473

USPC ..... 52/243, 481.1, 656.1, 690

See application file for complete search history.

(56) References Cited

U.S. PATENT DOCUMENTS

| | | | | |
|---|---|---|---|---|
| 2,405,293 | A * | 8/1946 | Dahlman | B01D 46/10 290/38 R |
| 3,305,981 | A * | 2/1967 | Biggs | E04B 2/7863 52/317 |
| 3,731,956 | A | 5/1973 | Hanley | |
| 4,047,355 | A * | 9/1977 | Knorr | E04B 2/7409 52/302.3 |

(Continued)

*Primary Examiner* — Basil Katcheves
*Assistant Examiner* — Joshua Ihezie
(74) *Attorney, Agent, or Firm* — The Culbertson Group, P.C.; Russell D. Culbertson

(57) ABSTRACT

A structural wall panel includes an elongated shared structural framing member and one or more elongated intermediate structural framing members. An elongated top track is connected to a top end of each of the framing members. An inner sheet of suitable sheet material may be secured to the framing members so as to form an inner face of the structural wall panel, while an outer sheet of suitable sheet material may be secured to the framing members so as to form an outer face of the structural wall panel opposite the inner face. The elongated top track and inner and outer sheets are aligned on the framing members so as to form a male receiver at one lateral side of the panel and a female receiving structure along the opposite lateral side of the panel.

12 Claims, 24 Drawing Sheets

(56) References Cited

U.S. PATENT DOCUMENTS 4,612,848 A * 9/1986 Pollack ..... E21F 1/14 182/159
4,757,663 A * 7/1988 Kuhr ..... E04B 2/7409 52/481.1
4,793,113 A * 12/1988 Bodnar ..... E04B 2/58 52/481.1
5,040,345 A * 8/1991 Gilmour ..... E04B 2/825 52/238.1
5,218,803 A * 6/1993 Wright ..... E04B 2/789 52/243
5,285,615 A * 2/1994 Gilmour ..... E04B 2/7412 52/781
5,313,752 A * 5/1994 Hatzinikolas ..... E04B 2/58 52/243
5,381,915 A 1/1995 Yardley
5,412,919 A * 5/1995 Pellock ..... E04B 2/60 52/241
5,417,023 A * 5/1995 Mandish ..... E04B 2/58 52/309.14
5,685,121 A * 11/1997 DeFrancesco ..... E04C 3/07 52/241
5,735,100 A * 4/1998 Campbell ..... E04B 1/3447 52/126.6
6,047,519 A * 4/2000 Bagn ..... E04C 2/384 52/656.1
6,050,045 A * 4/2000 Campbell ..... E04B 1/3441 52/126.6
6,176,053 B1 * 1/2001 St. Germain ..... E04B 2/825 52/232
6,318,044 B1 * 11/2001 Campbell ..... E04B 1/3441 52/293.1
6,510,667 B1 * 1/2003 Cottier ..... E04B 2/8647 52/310
6,843,035 B1 * 1/2005 Glynn ..... E04B 2/7457 52/481.1
6,854,237 B2 * 2/2005 Surowiecki ..... E04B 2/7457 403/230
6,857,237 B1 * 2/2005 Dalphond ..... E04C 2/384 52/284
7,155,865 B2 1/2007 Rosenberg
7,383,665 B2 * 6/2008 Frobosilo ..... E04B 2/58 52/204.2
7,513,082 B2 * 4/2009 Johnson ..... E04B 2/7412 52/144
7,681,365 B2 * 3/2010 Klein ..... E04B 2/7411 52/1
7,849,640 B2 * 12/2010 Rice ..... E04B 2/7457 33/483
8,028,487 B2 * 10/2011 Engstrom ..... E04B 2/7457 52/126.6
8,033,065 B2 10/2011 Paetkau et al.
8,151,526 B2 * 4/2012 Klein ..... E04B 2/7411 52/1
8,322,094 B2 * 12/2012 Pilz ..... E04B 1/948 52/232
8,387,321 B2 * 3/2013 diGirolamo ..... E04B 2/58 52/241
8,615,959 B2 * 12/2013 Ferguson ..... E04C 3/07 52/241
2002/0002806 A1 * 1/2002 Commins ..... E04B 1/26 52/481.1
2005/0076600 A1 * 4/2005 Moody ..... E04B 2/58 52/633
2007/0011969 A1 * 1/2007 Little ..... E04B 2/7457 52/415
2007/0209306 A1 * 9/2007 Andrews ..... E04B 2/7411 52/317
2008/0016802 A1 * 1/2008 Rheaume ..... E04C 2/384 52/220.1
2008/0196332 A1 * 8/2008 Surowiecki ..... E04B 2/60 52/204.2
2008/0263968 A1 10/2008 Day
2009/0188188 A1 * 7/2009 Rivet ..... A62C 99/0081 52/270
2009/0223161 A1 9/2009 Segall
2010/0037546 A1 * 2/2010 Beck ..... E04B 1/24 52/282.4
2010/0269439 A1 * 10/2010 Morrisette ..... E04B 1/08 52/309.4
2010/0293888 A1 * 11/2010 Andrews ..... E04B 2/7457 52/800.12
2011/0000147 A1 1/2011 Heidenreich

* cited by examiner

STRUCTURAL WALL PANELS FOR USE IN LIGHT-FRAME CONSTRUCTION AND METHODS OF CONSTRUCTION EMPLOYING STRUCTURAL WALL PANELS

CROSS-REFERENCE TO RELATED APPLICATIONS

The Applicant claims the benefit, under 35 U.S.C. §120, of U.S. patent application Ser. No. 14/065,288 filed Oct. 28, 2013, to be issued as U.S. Pat. No. 8,997,424. The entire content of this patent is incorporated herein by this reference.

The Applicant also claims the benefit, under 35 U.S.C. §119(e), of U.S. Provisional Patent Application No. 61/795,872 filed Oct. 27, 2012, and entitled "Building Construction With Modular Panels Using Common Building Material," and U.S. Provisional Patent Application No. 61/796,410 filed Nov. 9, 2012, and entitled "Reusable Structure Wall Panels for the Conversion from Temporary to Either Temporary or Permanent Structures." The entire content of each of these provisional applications is incorporated herein by this reference.

TECHNICAL FIELD OF THE INVENTION

The present invention relates to building construction, and, more particularly, to a structural wall panel which may be prefabricated remotely from a construction site and used to quickly construct a light-frame building with reduced labor cost and reduced material waste. A building using structural wall panels according to the invention may also be disassembled so as to recover the structural wall panels for reuse in constructing a different building. The invention encompasses structural wall panels, methods of construction using such panels, and building structures built using such wall panels and methods.

BACKGROUND OF THE INVENTION

Current light-frame construction practices are tied to a serial building process with very little ability to optimize the timeline to erect a building or residence. The construction process starts with building the foundations and then the building frame. Once the building frame is complete, roof decking and roofing material, exterior sheathing (such as OSB or other engineered wood sheets), wiring, plumbing, and insulation, are added. Finally, the framed walls are closed typically by adding interior drywall, and the drywall is finished and made ready for painting by adding any desired finish texture. Moisture barriers on the exterior wall surfaces and exterior cladding or siding can be added anytime in this process after installation of exterior sheathing and roofing.

One of the problems associated with current light-frame construction practices is that the framing process requires a certain degree of on-site skilled labor. Framing together with installing exterior sheathing, adding wiring and insulation, and then installing interior wall sheeting such as drywall are time-consuming and require different trades. This all adds to the cost of construction. Another issue which arises in current light-frame construction is that forming individual framing members and sheeting pieces generates a significant amount of waste at the construction site in the form of framing material trimmings and trimmings from the exterior and interior sheeting material. All this waste material is typically combined with other construction waste in a roll-off container at the construction site and is commonly landfilled because such a combined waste stream is not readily recyclable.

There remains a need in the construction industry to address the inefficiencies and problems described above and others associated with current light-frame construction practices.

SUMMARY OF THE INVENTION

The present invention addresses the problems and inefficiencies in light-frame construction by providing structural wall panels which may be installed on a suitable foundation and connected together to quickly form a system of complete light-frame structural walls for a building, in some cases complete with exterior sheathing and interior sheet material. The basic building structure may then be completed by adding roof framing and then roof decking Structural wall panels according to some embodiments of the present invention combine framing, insulation, utilities, services, and framing enclosure with appropriate sheet materials so that the wall framing, insulation, and frame enclosure is complete or nearly complete once the panels are installed. This eliminates a great deal of work by different trades at the construction site, and also eliminates much of the waste stream commonly generated at the construction site. Furthermore, structural wall panels according to the present invention are readily recovered intact from a building and may be reused to construct another building of the same or different layout. In particular, structural wall panels according to embodiments of the present invention may be used to construct temporary structures such as temporary housing and then recovered from that structure and used to build a completely different temporary or permanent structure. Additionally, structural wall panels embodying the principles of the invention may be installed using simple tools and common fasteners, and the framing materials for the panels may be selected to meet International Building Code (IBC) standards and other common building standards for any structure in which the panels may be used.

A structural wall panel according to one form of the invention includes an elongated shared structural framing member and one or more elongated intermediate structural framing members all arranged generally parallel to one another. An elongated top track is connected to a top end of each intermediate structural framing member and the shared structural framing member. In this embodiment an inner sheet of suitable sheet material is secured with a number of inner sheet fasteners to the shared structural framing member and each intermediate structural framing member so as to form an inner face of the structural wall panel, while an outer sheet of suitable sheet material is secured with a number of outer sheet fasteners to the shared structural framing member and each intermediate structural framing member so as to form an outer face of the structural wall panel opposite the inner face. The elongated top track includes a first end located at an intermediate point of the top end of the shared structural framing member and a second end terminating at one lateral side of the structural wall panel. The inner and outer sheets in this embodiment are each aligned with the top track so that one lateral edge of each sheet is positioned along the intermediate point of the shared structural framing member and the opposite lateral edge of each sheet forms a female receiver structure for receiving the shared structural framing member of an adjacent structural wall panel. The portion of the shared structural framing member that protrudes past the sheet material forms a male connector which may be received in the inner and outer sheet receiving structure defined by another adjacent structural wall panel. A structural wall panel according to this embodiment of the present invention also includes a receiver structure associated with a bottom end of each intermediate structural framing member and the shared structural framing member for receiving a portion of a bottom track to secure the structural wall panel to a foundation or floor decking.

The wall panel structure including a female receiver formed by the inner and outer sheets on one lateral side of the wall panel structure in this embodiment and the protruding portion of the shared structural framing member forming a male connector at the opposite lateral side allows adjacent wall panel structures to be placed together in an interlocking fashion on a suitable bottom track and secured together with standard fasteners to produce a code-compliant structural wall. Wall panels may be formed as plain shear wall panels, or may incorporate openings for doors, windows, or utilities. These different wall structural wall panels may be arranged to provide any number of wall layouts. Structural corner elements providing a corresponding male connector and a corresponding female receiver may be used to connect adjacent structural wall panels to form building corners. Structural T elements may be used to connect a structural wall panel to a series of wall panels aligned along a straight line so as to provide interior walls for example.

The receiver structure at the bottom end of a structural wall panel according to the above-described embodiment of the present invention may include a respective inner receiving slot and a respective outer receiving slot associated with each intermediate structural framing member and the shared structural framing member. Each inner receiving slot forms a strap receiving space defined between the respective structural framing member and the inner sheet, while each outer receiving slot forms a strap receiving space defined between the respective structural framing member and the outer sheet. A bottom track installed in the desired position on a foundation or floor deck may include upwardly extending strap members. When a given one of the structural wall panels is lowered onto the bottom track, the upwardly extending strap members extend into the inner and outer receiving slots and a suitable fastener may then be driven through the respective sheet material and the strap member and into the structural framing member so as to provide a secure and code-compliant connection between the wall panel and the foundation or floor deck. Several different types of bottom tracks which may be employed with structural wall panels according to the invention will be described below in the description of illustrative embodiments.

A method of building construction according to one form of the invention includes securing an elongated bottom track on a suitable support surface (either a foundation surface or a floor deck) to define the position of a wall section for a building. The bottom track defines at least two and perhaps many panel locations along a straight line, each panel location for receiving a respective one of the structural wall panels according to the present invention. Once the bottom track is secured, a first one of the structural wall panels is then positioned in an installation orientation at a first one of the panel locations on the bottom track. The installation orientation comprises an orientation in which the bottom side of the respective structural wall panel aligns with the bottom track and the shared structural framing member and each intermediate structural framing member of the respective structural wall panel each extend substantially vertically from the bottom track. This method further includes positioning an additional one of the structural wall panels in the installation orientation at each remaining panel location. Due to the receiving structure formed by the structural wall panels along one lateral side and the male connector comprising the protruding portion of the shared structural framing member formed at the opposite lateral side, positioning the wall panels in the panel locations along the bottom track places the panels in an interlocking relationship. In this interlocking relationship the shared structural framing member of one of two adjacent structural wall panels is received between the respective inner and outer sheet edges of the other of the two adjacent structural wall panels in this embodiment including the inner and outer sheet material. Also in this interlocking relationship, the edges of inner and outer sheets of one of two adjacent structural wall panels abut the respective inner and outer sheet edges of the other of the two adjacent structural wall panels so as to form a continuous enclosed structural wall made up of individual interlocking structural wall panels.

This example building construction method also includes securing the bottom of each structural wall panel to the bottom track and securing each of the panels to each other in the interlocking relationship. Suitable fasteners may be used to secure the panels to the bottom track and to each other as described above, and as will be described below with reference to the drawings.

Structural wall panels according to the present invention may be used to build structural framed walls on any suitable foundation or substrate. The foundation may be concrete or floor decking made of a suitable material such as plywood. The surface on which the panels may be installed may be a first floor surface or a second or higher floor surface. As used in the following disclosure and the claims, the surface upon which the wall panels are mounted will simply be referred to as a "foundation" regardless of the material from which the surface is made and regardless of whether it is a first floor surface or a second or higher floor surface.

The present invention also encompasses both a building structure produced using structural wall panels according to the invention, and a method of reusing such panels already installed in a building structure. A building structure within the scope of the present invention includes at least one framed wall section residing on a foundation and including at least two adjacent panel locations. This framed wall section includes a respective one of the panels secured via a respective bottom side connector for that panel (such as the bottom side receiver structure described herein) and a number of bottom side fasteners to the foundation at a respective one of the at least two adjacent panel locations. The installed panel also has its first lateral side connector (such as the male connector described above) mated with the second lateral side connector of a respective panel at the other one of the at least two panel locations. The second lateral side connector may comprise the female receiver defined between the inner and outer sheets as described above. Each panel in the framed wall section has a number of lateral side fasteners connected along each lateral side of that respective panel. In this installed arrangement of panels along the framed wall section, the wall section provides structural support for supporting an edge of an upper story structure or a roof structure of the building. The panels incorporated in such a wall section may be uninstalled from the wall section and reused by reinstalling them in another structure.

These and other advantages and features of the invention will be apparent from the following description of illustrative embodiments, considered along with the accompanying drawings.

DESCRIPTION OF ILLUSTRATIVE EMBODIMENTS

The claims following this section set out novel features which the Applicant believes are characteristic of the invention. The various advantages and features of the invention together with various modes of use of the invention will best be understood by reference to the following description of illustrative embodiments read in view of the drawings introduced above.

Figure 6:
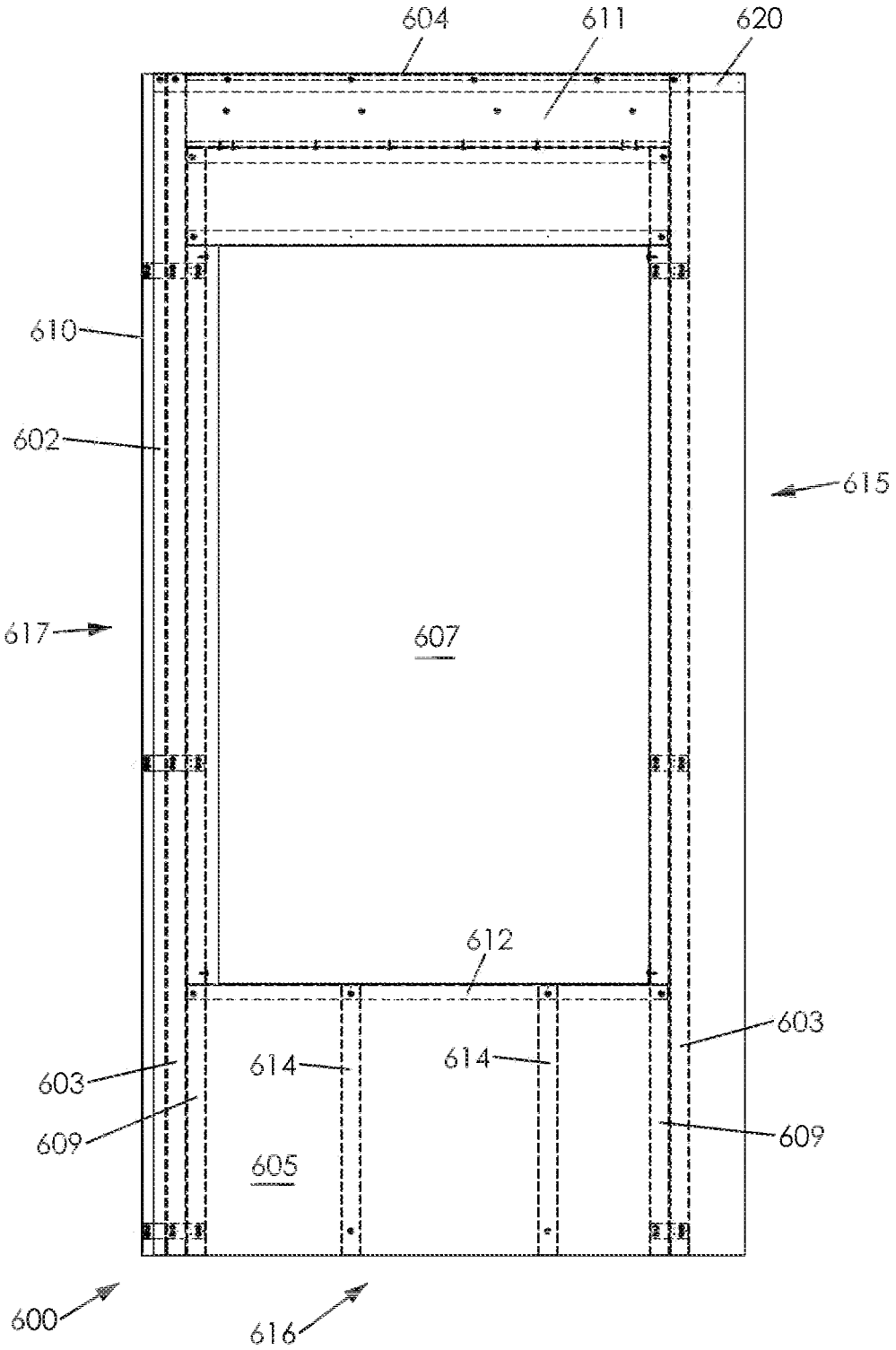
FIG. 6 is a side view of a window wall panel according to an embodiment of the present invention.
Figure 7:
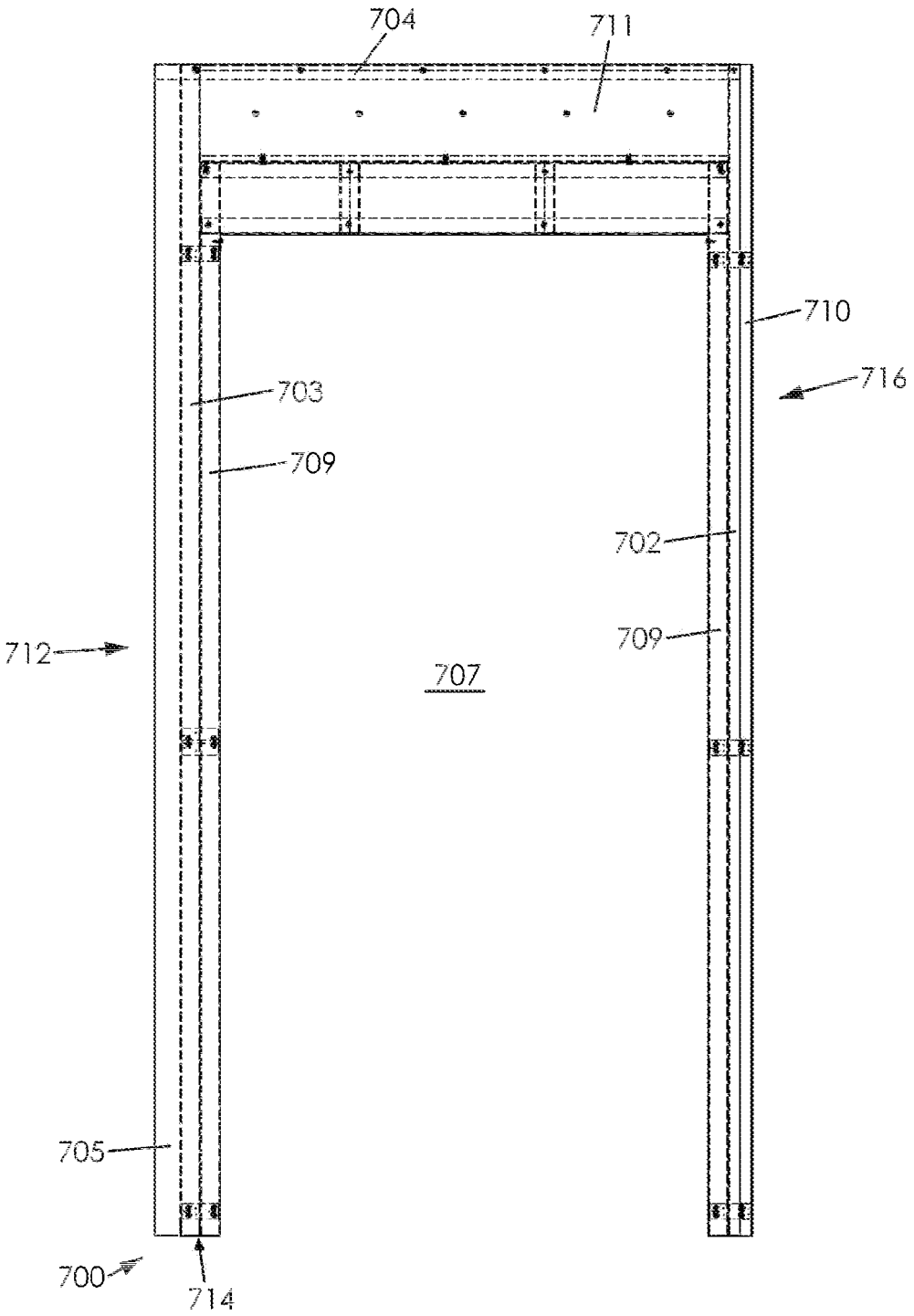
FIG. 7 is a side view of a door wall panel according to an embodiment of the present invention.
Figure 8:
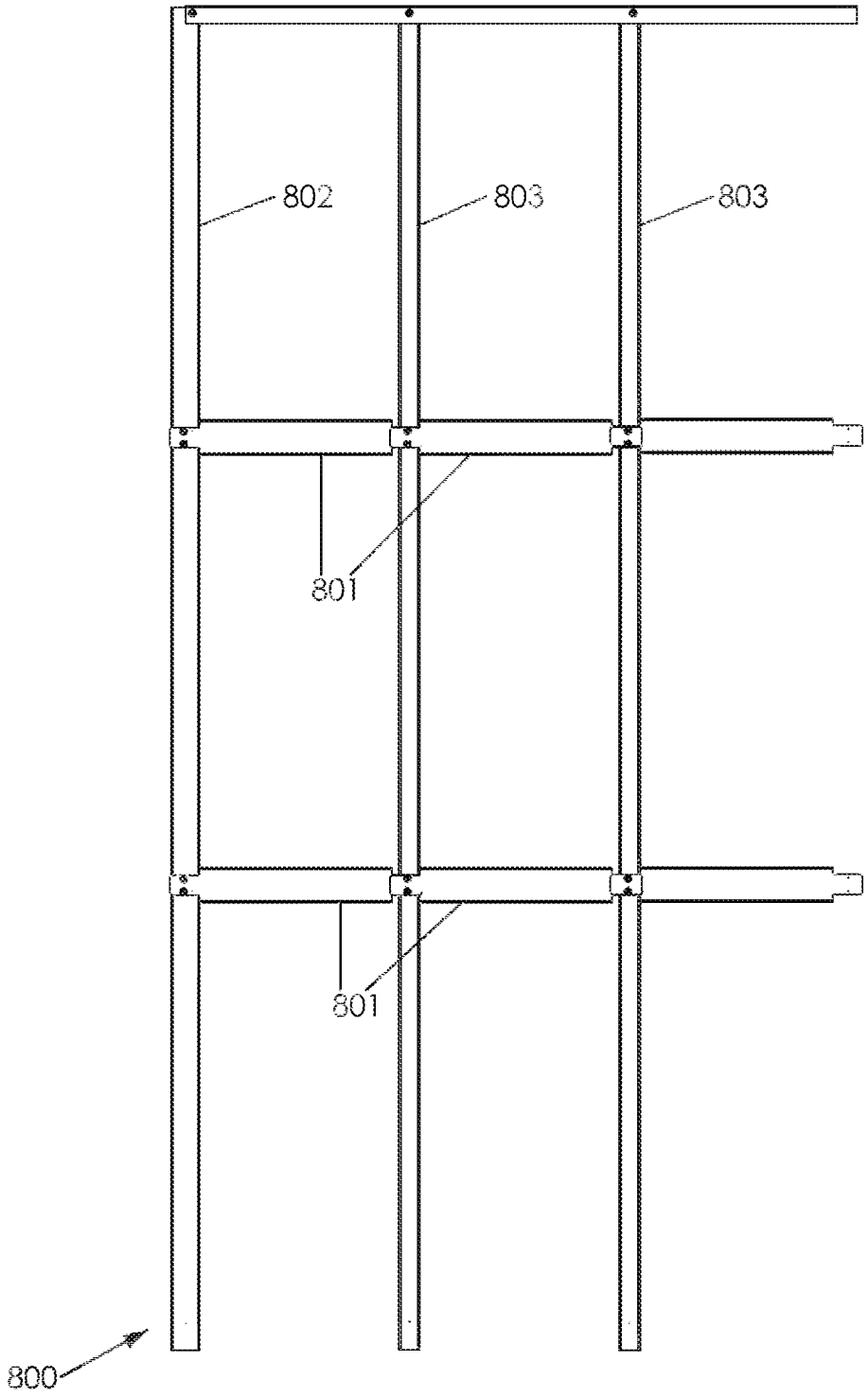
FIG. 8 is a side view of a wall panel with blocking according to an embodiment of the present invention.
Figure 9:
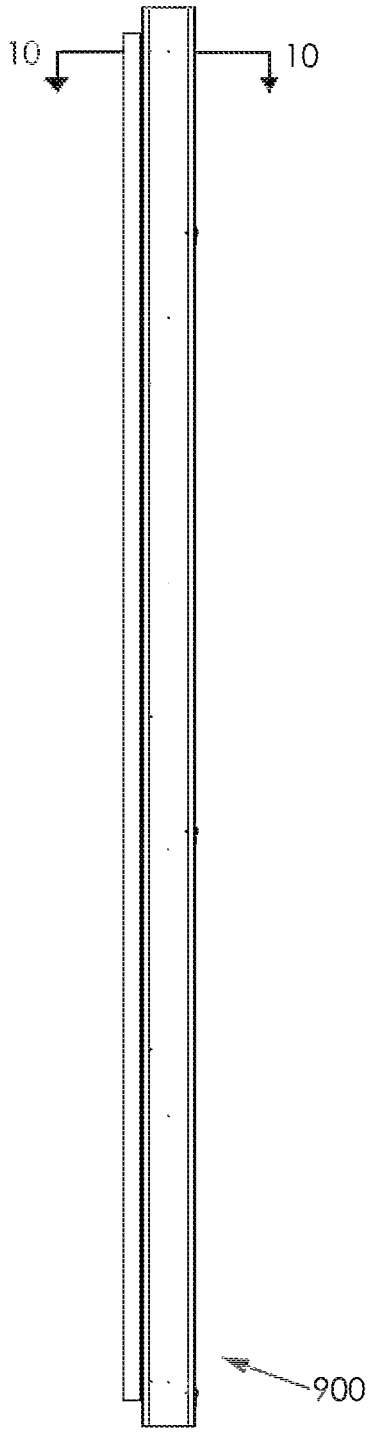
FIG. 9 is a side view of a corner framing structure according to an embodiment of the present invention.
Figure 10:
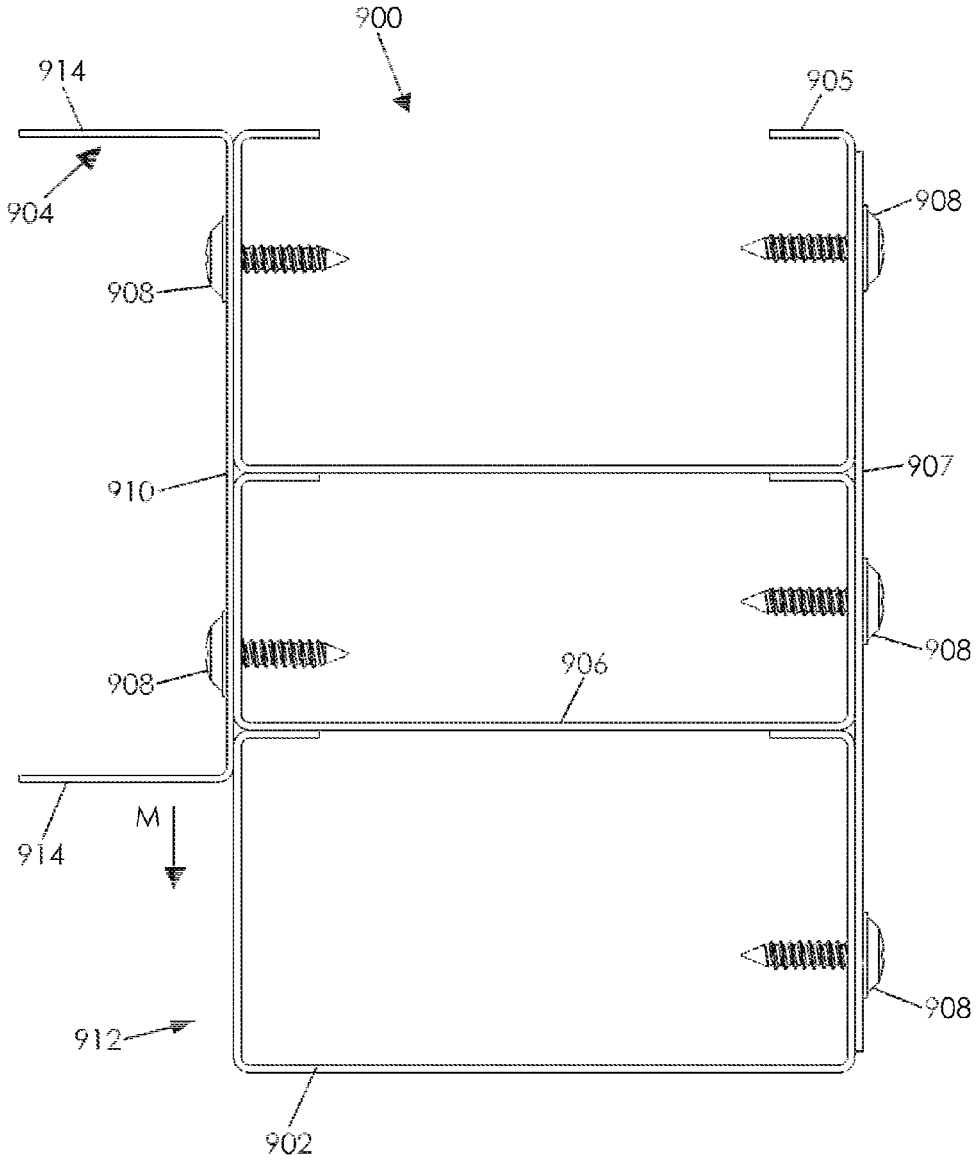
FIG. 10 is a view in section taken along line 10-10 in FIG. 9.
Figure 21:
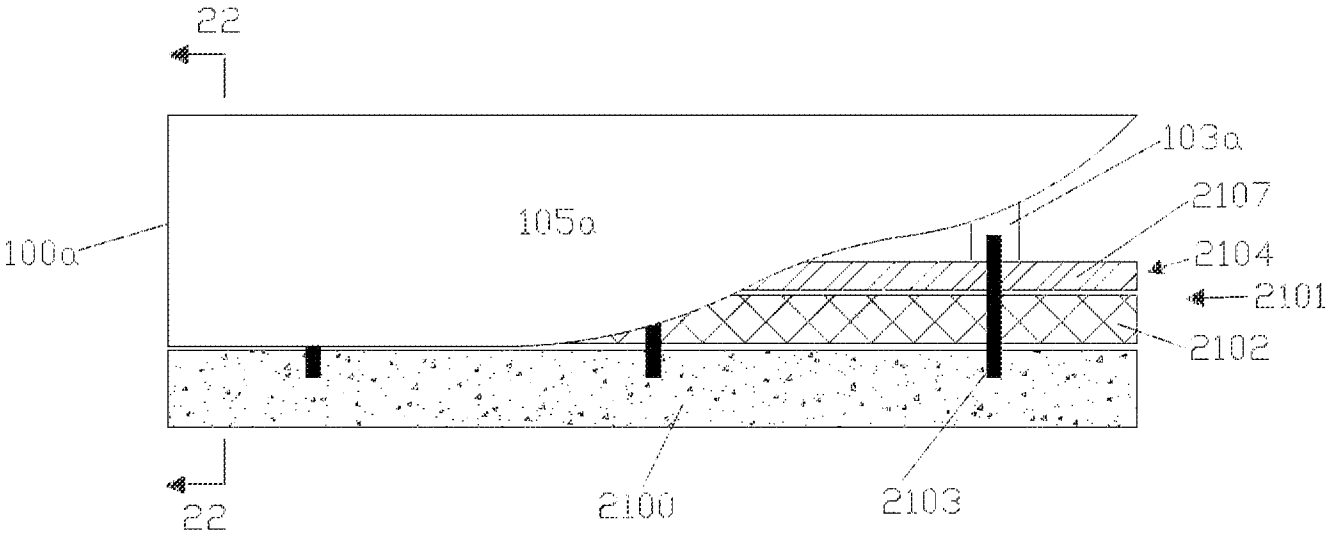
FIG. 21 is a somewhat diagrammatic view in section of a portion of an alternate bottom track and a portion of a structural wall panel similar to the panel shown in FIG. 1.
Figure 22:
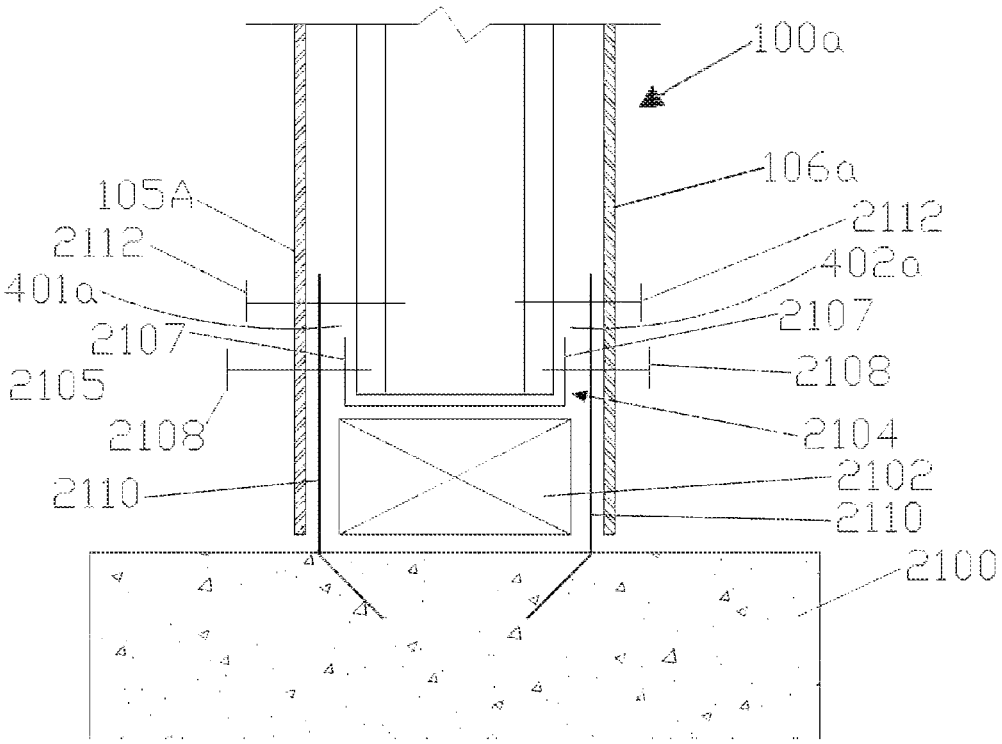
FIG. 22 is a diagrammatic section view taken along line 22-22 in FIG. 21.

In the following description, FIGS. 1-5 will be used to describe an example structural wall panel according to one particular embodiment of the invention as well as certain variations on that embodiment within the scope of the invention. FIGS. 6-8 will be used to describe different structural wall panels which may be combined with the panel described in FIGS. 1-5 to construct a building according to the present invention. FIGS. 9 and 10 will be used to describe a corner framing structure which may be employed to connect to panels to form a building corner. FIGS. 11-15 will be used to describe how the various structural wall panels may be installed on a foundation according to the present invention. FIGS. 16-20 will be used to describe several example configurations for buildings constructed according to the present invention. FIGS. 21 and 22 will be used to describe alternate bottom tracks for use in installing structural wall panels according to the present invention.

In the following description of figures, unless specifically indicated otherwise, relative position or orientation references such as upper or lower and top or bottom will refer to the orientation of the particular structure referenced in the figures. The terms inner and outer will be used in the following description to refer to opposite faces of a structural wall panel simply to distinguish one face from another and not to indicate an interior face or exterior face, unless stated otherwise.

Figure 1:
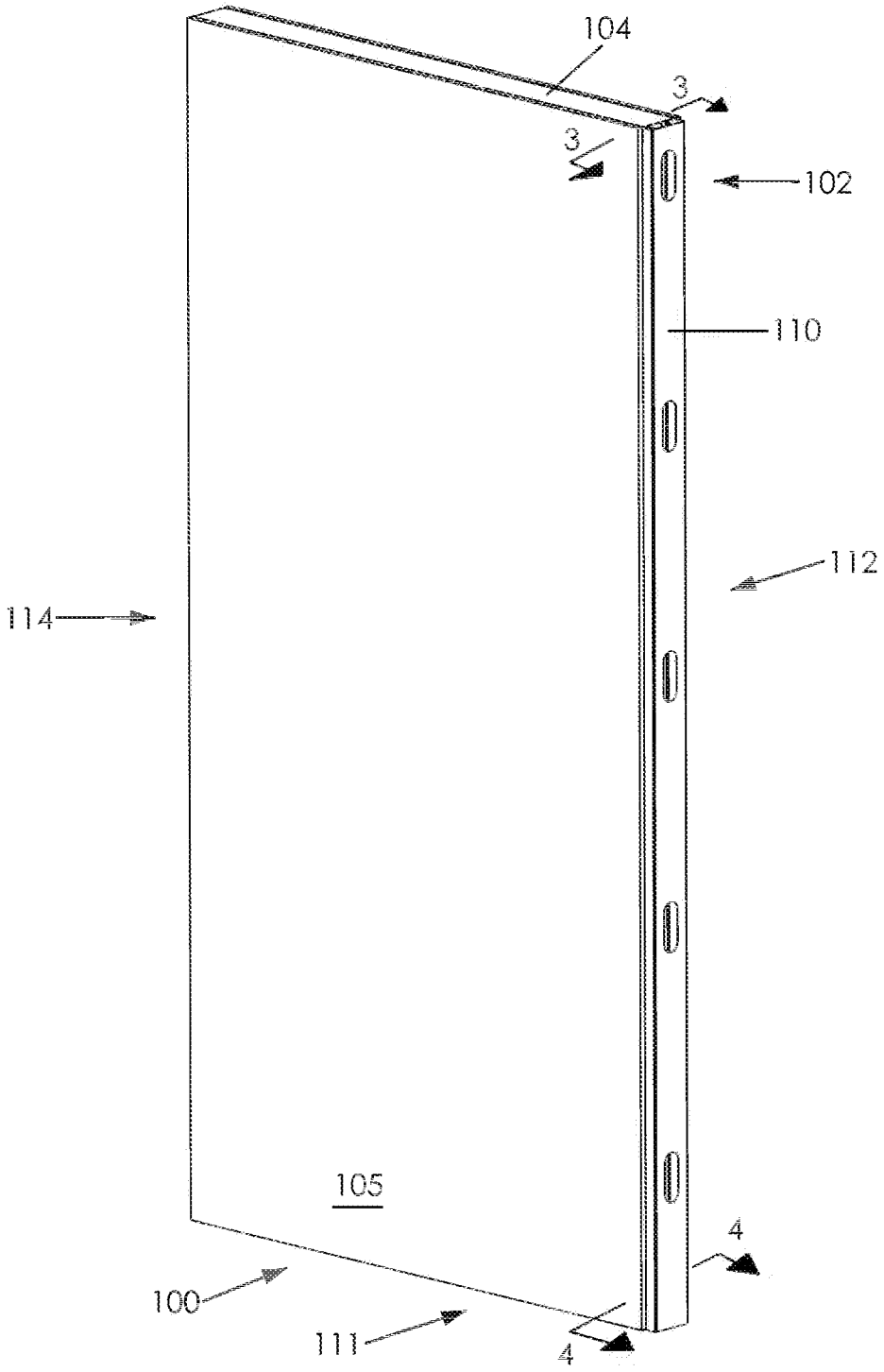
FIG. 1 is a view in perspective of a complete shear wall panel according to an embodiment of the present invention.
Figure 1A:
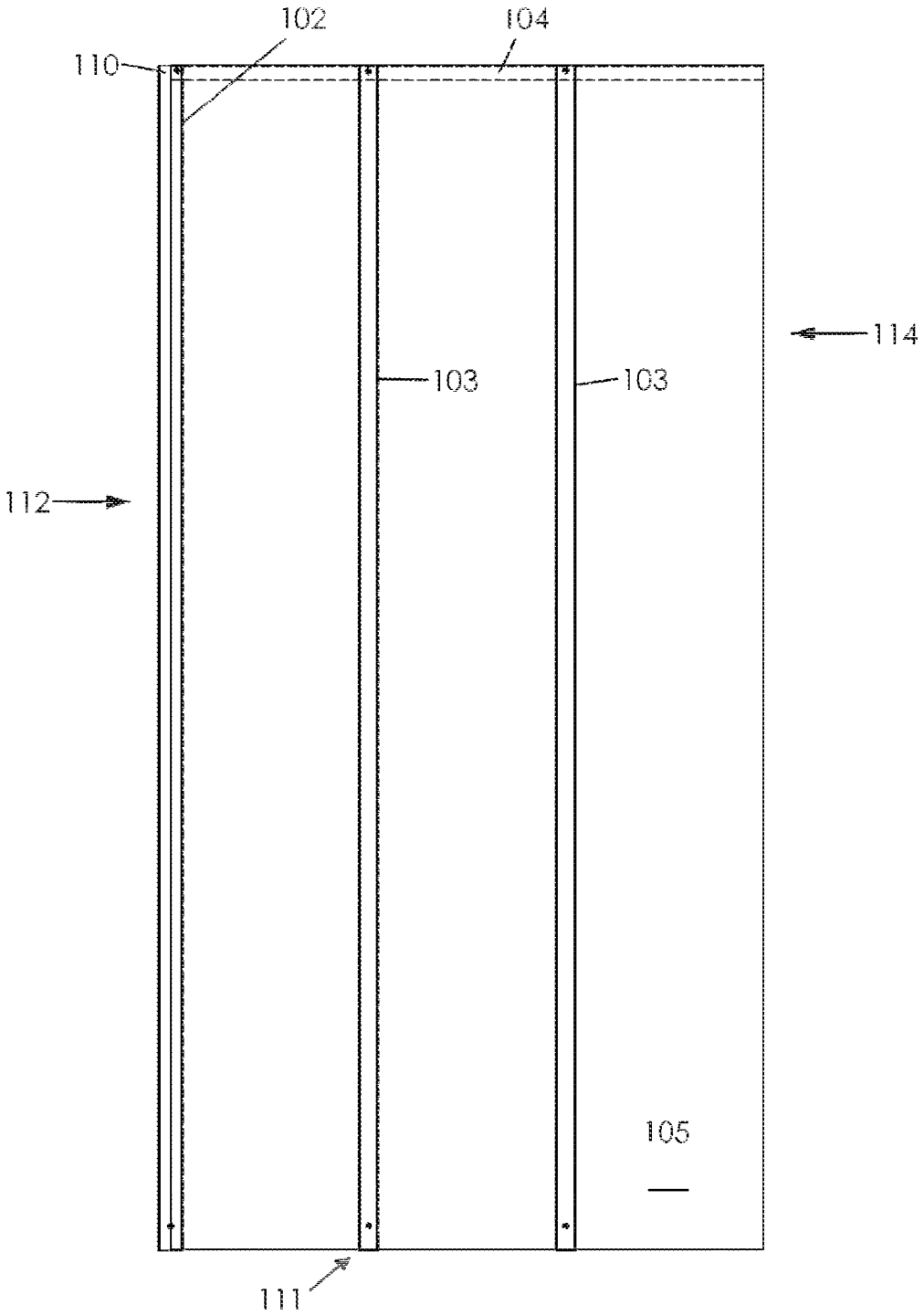
FIG. 1A is a side view of the wall panel shown in FIG. 1.
Figure 2:
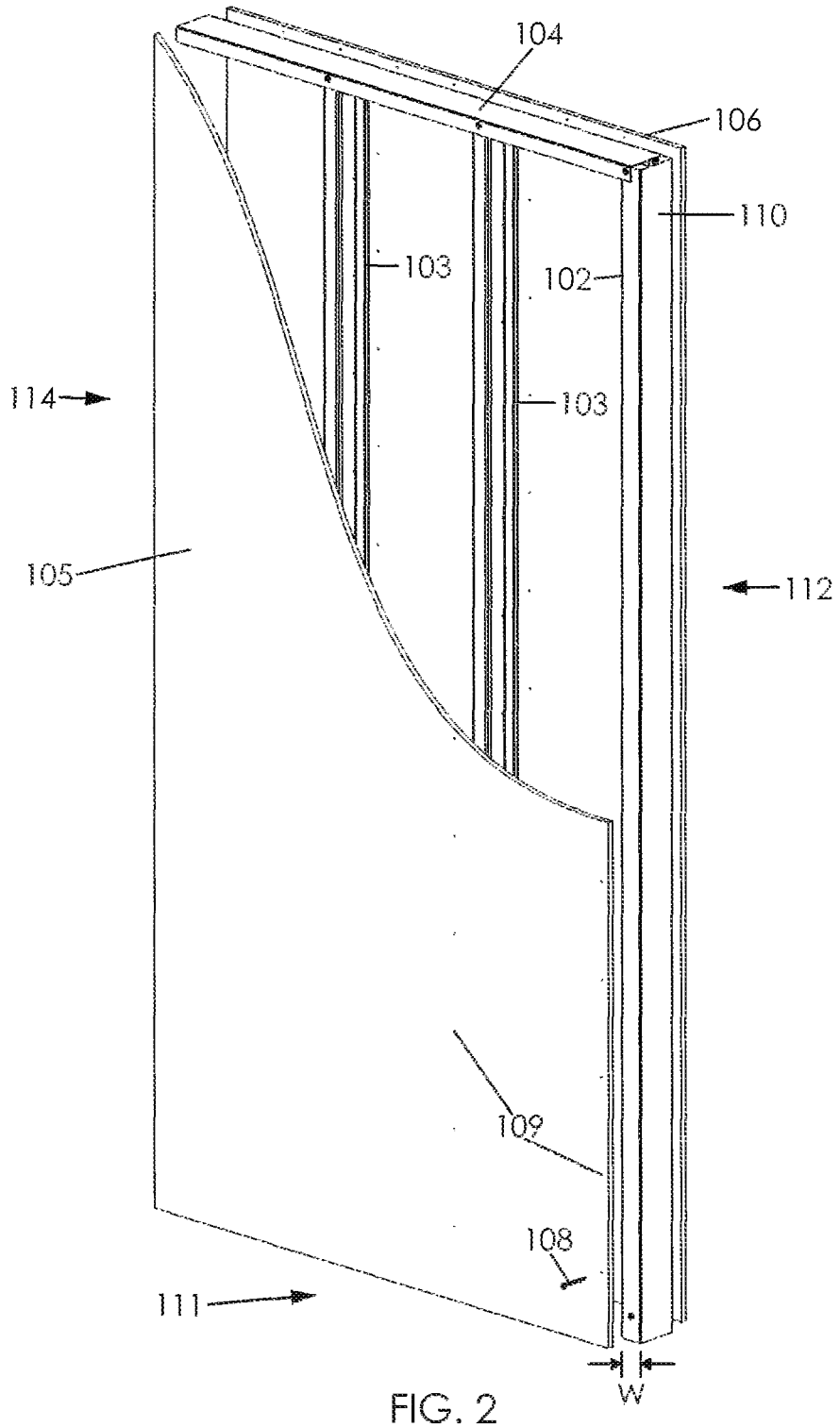
FIG. 2 is a partially exploded view in perspective of the shear wall panel shown in FIG. 1.

FIGS. 1, 1A, and 2 show an example structural wall panel 100. This particular panel 100 comprises a shear wall panel. Other structural wall panel modules for providing door, window, and utility openings will be described below in connection with FIGS. 6-8. As shown best in FIG. 1A and the partially exploded view of FIG. 2, panel 100 includes a shared structural framing member 102, two intermediate structural framing members 103, a top track 104, an inner sheet 105, and an outer sheet 106. These elements are all connected together with suitable fasteners 108 such as suitable screws or other fasteners suitable for driving through the sheet material 105 or 106 and into the underlying framing members 102 and 103 and top track 104. Some of the connecting points 109 for receiving a respective fastener 108 are shown for purposes of example in FIG. 2.

The framing members, both shared structural framing member 102 and each intermediate structural framing member 103 shown in FIG. 2, each comprise a respective metal framing member made of a suitable gauge steel or other metal. However, the invention is not limited to metal framing members. Any of the frame framing members described in this disclosure may comprise dimensional lumber or any other framing material suitable for providing the desired structural integrity for the resulting panel and for meeting applicable building codes in any structure in which the resulting panel may be employed. Regardless of the material from which they are made, the framing members (such as shared structural framing member 102 and the intermediate structural framing members 103) must have sufficient strength to bear the dead and live loading applied to the wall panel 100 in the vertical direction. It will be appreciated that the shared structural framing member 102 and intermediate structural framing members 103 shown in FIGS. 1A and 2 correspond to studs employed in current light-frame construction. Intermediate structural framing members 103 in particular may comprise standard studs used in light-frame construction. Shared structural framing member 102 may also be a standard stud used in current light-frame construction, however, framing member 102 has a width in the direction W shown in FIG. 2 that is at least a minimum dimension to facilitate fastening the inner and outer sheets 105 and 106, respectively, in the position shown and provide a protruding portion 110 sufficient to form a male connector for interconnection with an adjacent wall panel as will be described below. In particular the shared structural framing member 102 is preferably at least two inches wide in the dimension W. This compares with standard 2× dimensional lumber which is one and three-quarter inches wide in the dimension W.

It should be noted that in this shear wall panel embodiment shown in FIGS. 1, 1A and 2, the intermediate structural framing members 103 simply comprise the plain studs. As will be described below in connection with other structural wall panel modules, intermediate structural framing members may also comprise other types of studs including king studs which are used to frame around window and door headers. These other additional structural framing members will be described below in connection with the other modules shown in FIGS. 6-8.

Figure 3:
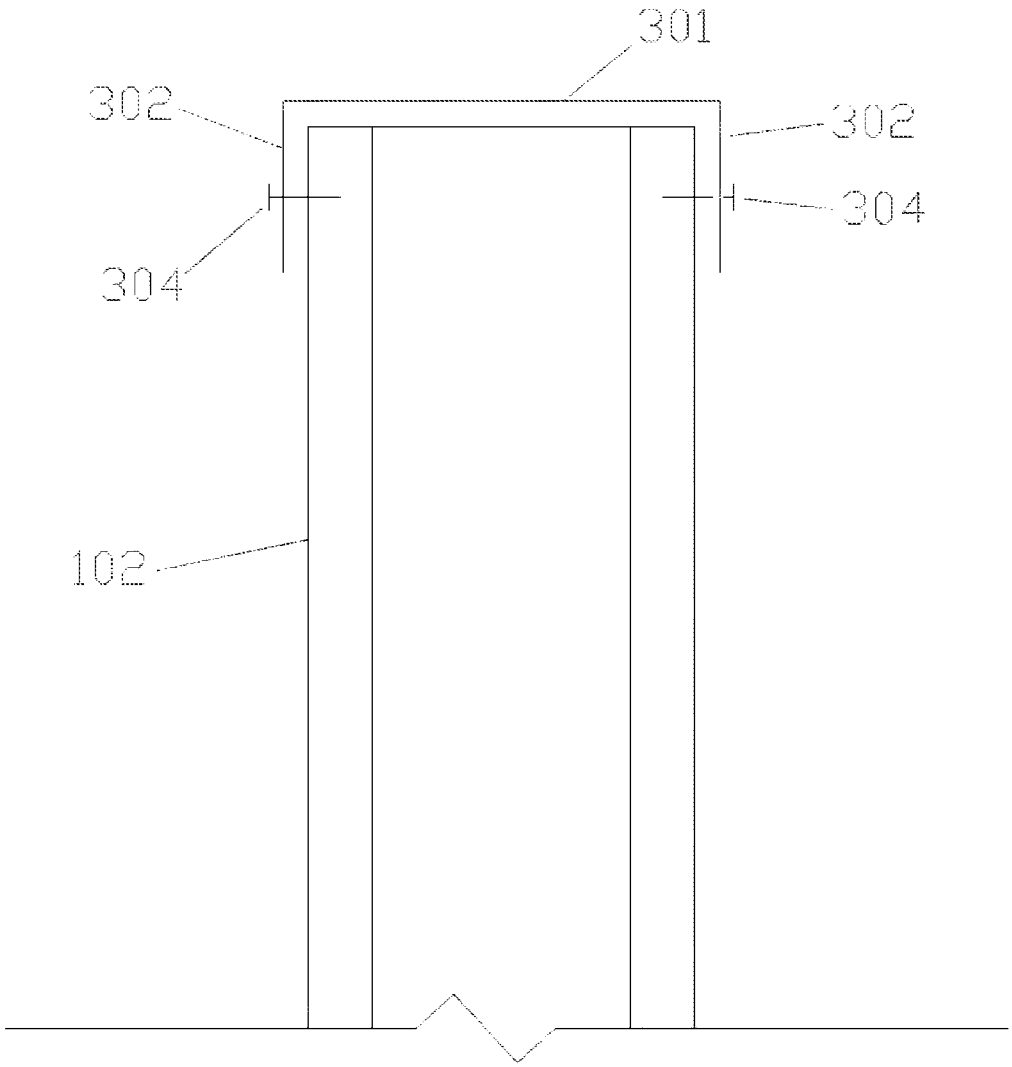
FIG. 3 is an enlarged diagrammatic section view of a top end of the shear wall panel shown in FIG. 1 taken along line 3-3 in FIG. 1 in that figure.

As shown best in FIGS. 2 and 3, top track 104 extends over and lies against the top end of each of the structural framing members 102 and 103. The function of top track 104 is to help maintain the essentially vertical alignment of the structural framing members 102 and 103 and to provide a structural bearing feature for receiving additional structural elements such as upper floor joists and roof joists. The illustrated top track 104 comprises a length of metal C-channel having a web 301 and two legs 302, one leg depending from either side of the web to form a C-shaped cross section (with the opening of the C-shape facing down in the orientation of FIG. 3). As shown in both FIGS. 2 and 3, leg members 302 each extend along a portion of the length of each framing member 102 and 103 and provide a place for receiving a fastener 304 to connect the top track to the respective framing member. These fasteners 304 may or may not be the same type of fasteners 108 driven through the sheet material 105 and 106 as shown in FIG. 2. Also, it should be appreciated that top track 104 may be connected to the framing members 102 and 103 in any suitable manner and that the invention is not limited to screws or any particular fastener or fastening technique for connecting these components. It should also be appreciated that top track 104 need not comprise a length of metal C-channel as shown in the figures. In other embodiments the top track may comprise lumber or any other suitable material which may be connected in a suitable manner to framing members 102 and 103.

The inner and outer sheets, 105 and 106, respectively, enclose the framing members 102 and 103 to provide a suitable surface for either interior finishing or for exterior moisture proofing and cladding. For example, inner sheet 105 may comprise a sheet of drywall to provide an interior face for finishing in any desired manner. Outer sheet 106 may, for example, comprise OSB or other engineered sheet lumber to provide an exterior plane for receiving a moisture barrier and then a suitable exterior cladding such as cement board cladding or any other suitable cladding material. Other sheet materials that may be used as the sheet material may be, for example, MGO board, fiber cement board, steel or other metal sheeting, or any structural cladding. It will be appreciated that when the structural wall panel is to be placed in an interior of a structure, both the inner sheet 105 and outer sheet 106 may comprise drywall or other suitable interior wall material. It should also be appreciated that the connections to particularly an exterior material such as OSB or other engineered wood also provides support for the panel structure against relative movement between structure framing members 102 and 103 in the direction W shown in FIG. 2.

Figure 4:
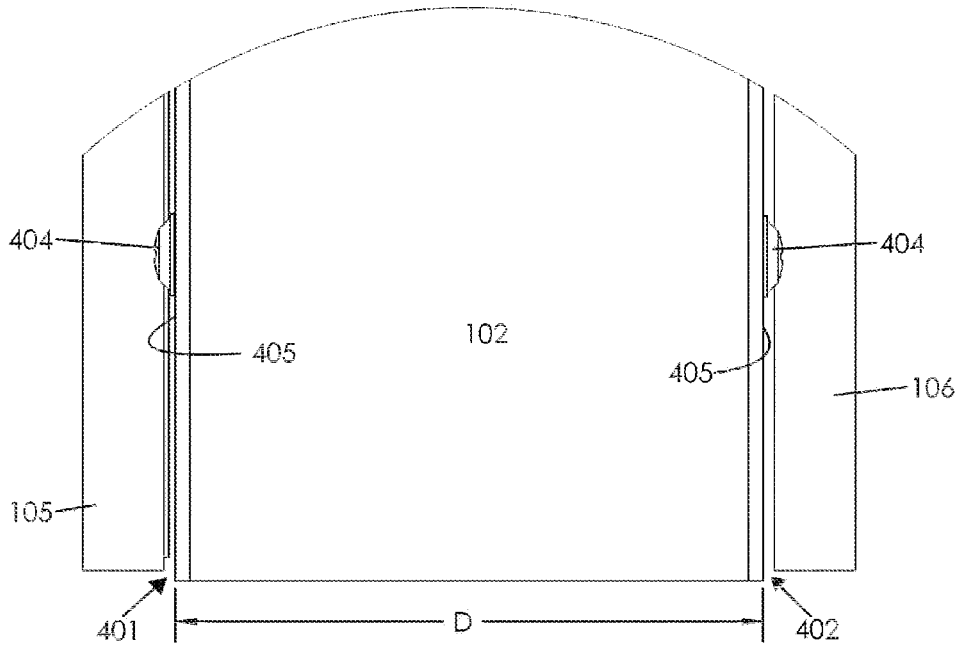
FIG. 4 is an enlarged section view of a bottom end of the shear wall panel shown in FIG. 1 taken along line 4-4 in that figure.

Structural wall panels such as panel 100 shown in FIGS. 1-5 incorporate features to facilitate installation on a suitable foundation and interconnection between adjacent panels to form a code-compliant framed wall structure which may be disassembled as desired to recover the wall panels for use in producing a different structure. A bottom end 111 of panel 100 includes a receiver arrangement as shown in FIG. 4 for installing the panel on a foundation. In particular, panel 100 includes a respective inner receiving slot 401 associated with each intermediate structural framing member 102 and the shared structural framing member 102. This inner receiving slot 401 comprises a strap receiving space defined between the respective structural framing member (102 in the section of FIG. 4) and the inner sheet 105. A respective outer receiving slot 402 is associated with each intermediate structural frame member 103 and the shared structural framing member 102. Each respective outer receiving slot 402 comprises a strap receiving space defined between the respective structural framing member (102 in the section of FIG. 4) and outer sheet 106. Although the inner and outer receiving slots, 401 and 402, respectively, may be formed in any suitable manner, one preferred arrangement includes a respective spacer 404 located on a surface 405 of each structural framing member facing the respective sheet 105 or 106 so as to prevent that sheet from laying flush against that surface 405. The spacer 404 may comprise, for example, the head of a suitable fastener which is driven into the respective structural framing member at a suitable location. The suitable location is a location that provides a receiving slot of a depth capable of receiving a connecting strap as will be described below in connection with FIGS. 11-14.

The features for interconnecting adjacent panels may be described in connection with FIGS. 1, 1A, and 2. As shown in FIGS. 1 and 1A, the protruding portion 110 of shared structural framing member 102 provides a male connector at a first lateral side 112 of panel 100. The opposing inner and outer sheets, 105 and 106, respectively, at the opposite lateral side 114 of panel 100, together with the end of top channel 104 at that lateral side of the panel, forms a female receiver. Because the sheets 105 and 106 are planar and are spaced apart by the depth of the framing members 102 and 103 (all having the same depth dimension D shown in FIG. 4), the edges of the sheets are spaced apart the correct amount to receive the protruding portion 110 of the shared structural framing member of an adjacent panel of the same construction. Of course, legs 302 of top track 104 are also spaced apart appropriately to closely receive the protruding portion 110 of shared structural framing member 102. Thus a number of panels 100 may be placed one lateral side to another with the female receiver formed by the top track 104 and sheets 105 and 106 of one panel receiving the protruding portion 110 of the shared structural framing member 102 of an adjacent panel to provide an interlocking series of the panels. The manner in which the panels such as panel 100 interlock for forming a complete structural wall will be described further below in connection with FIGS. 11-15.

It will be noted that the complete structural wall panel 100 shown in FIGS. 1-6 is actually structurally incomplete by itself. That is, the lateral side 114 forming the female receiver includes no structural framing member since, as best shown in FIG. 1A, top track 104 extends well past the nearest intermediate structural framing member 103 to that lateral side. As also shown in FIG. 1A, this distance between the end of top track 104 past the nearest intermediate framing member 103 at lateral side 114 is equal to the distance between the end of the top track at the first lateral side 112 of panel 100 and the nearest intermediate framing member 103 to that side. Also, there is no structural member at the bottom end of panel 100 to help retain structural framing members 102 and 103 in the desired parallel orientation, although the connections to the sheets 105 and 106 provide some support in this regard. Furthermore, the sheet material 105 and 106 are fastened only along the legs 302 of top track 104 along shared structural framing member 102 and along the intermediate framing members 103, and are not fastened to anything along the lateral side 114 of panel 100 or along bottom end 111 of panel 100. It is only when panel 100 is interlocked and connected with an adjacent panel and both are connected to a foundation that the panels together become structurally complete to produce a code-compliant framed wall structure with the sheet material 105 and 106 connected along all four sides of the material, including lateral side 114 and bottom side 111.

Figure 5:
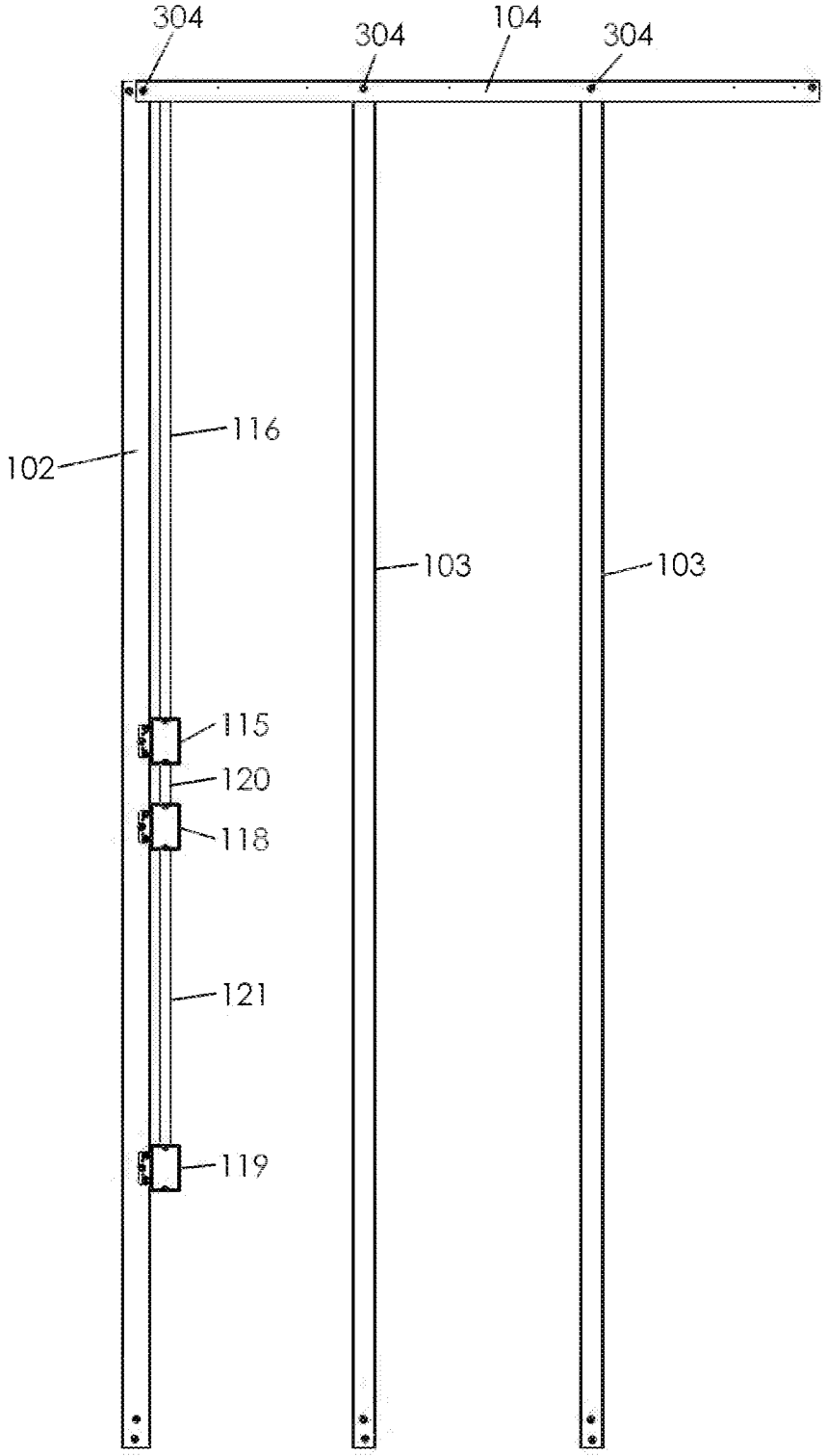
FIG. 5 is a side view similar to FIG. 1A, but showing the shear wall panel with the sheet material removed to expose all of the interior structure of the panel including an arrangement of electrical boxes.

The side view of FIG. 5 shows how electrical receptacle or switch boxes and other electrical or communications boxes may be incorporated into structural panel 100 according to one form of the present invention. The electrical box 115 may be secured to the desired structural framing member (in this case framing member 102) and a suitable conduit 116 may be secured to that framing member so as to extend from the installed box to an opening (not shown) in top track 104. Where additional electrical boxes, such as boxes 118 and 119, are installed as shown in FIG. 5, additional lengths of conduit 120 and 121 may connect the lower boxes to the upper box 115. Pull lines may be installed in the conduit and boxes to facilitate pulling electrical wires through the boxes and conduit at the appropriate time in the construction process.

Plumbing lines may also be included in structural wall panels according to the present invention. Water supply tubing may be secured to one of the structural framing members 102 or 103 similarly to electrical conduit 116. Alternatively, water supply tubing may be secured to blocking material extended between the vertical structural framing members. In either case, an L may be included at the bottom end of the water supply tubing to connect a portion of tubing extending out through one of the sheets 105 or 106. The upper end of the water supply tubing would extend through a hole in the top track 104 of the respective panel in position to allow connection to a water supply line positioned in the structure installed above the wall framing such as the area of roof trusses or upper level floor trusses. Sewer lines and vent tubing may be included in a panel 100 as well. The sewer vent tubing may be secured to one of the vertical structural framing members or to blocking installed between the vertical structural framing members and may extend upwardly through a hole in the top track 104 of the respective panel. Sewer line tubing may be secured to one of the vertical structural framing members or to blocking extending between the vertical framing members and extend downwardly to the bottom side of the panel in position to connect to a sewer line in the foundation on which the panel is to be installed.

Although not shown in the example of FIGS. 1-5, suitable insulation or soundproofing material may be installed between the structural framing members 102 and 103 prior to securing the last of the inner and outer sheets, 105 and 106, respectively. For example, thermal insulation batts may be installed between the structural framing members 102 and 103 (and to the left of the leftmost intermediate framing member 103) where the wall panel is intended for use as an exterior wall. Sound deadening batts or other material may be installed in the same locations for panels intended for use as an interior wall.

FIG. 6 shows a side view of a structural window wall panel 600 according to an embodiment of the invention. In this view, all the interior structure of panel 600 is shown in hidden lines behind inner sheet 605 which corresponds to the inner sheet 105 shown in FIG. 1. It should be appreciated that panel 600 also includes an outer sheet material 606 which is not visible in FIG. 6, but is visible in the section view of FIG. 13A described below. Panel 600 includes a shared structural framing member 602 and a top track 604 similar to the corresponding elements 102 and 104 shown best in FIG. 2. However considering panel 600 includes a window opening 607, it also includes somewhat different intermediate structural framing members and additional structure not included in example panel 100. In particular, panel 600 includes intermediate structural framing members 603 which comprise king studs. Panel 600 also includes jack studs 609 which support a header 611. A sill 612 extends horizontally between jack studs 609 and is supported by cripple studs 614.

Panel 600 incorporates the same receiving and other elements for providing connections to adjacent panels identical to corresponding elements in panel 100 shown in FIGS. 1-5. Specifically, at lateral side 617 of panel 600, a protruding portion 610 of shared structural framing member 602 provides a male connector for connecting with a female receiver of an adjacent panel. The spaced apart inner and outer sheets, 605 and 606 respectively, and legs 620 of top track 604 at lateral side 615 of panel 600 form a female receiver for receiving the protruding portion of the shared structural framing member (such as 102 or 602 for example) of another adjacent panel. Thus panel 600 is adapted to be interlocked and interconnected with adjacent panels similarly to panel 100 described above in connection with FIGS. 1-5.

The bottom end of panel 600 also includes a receiver structure similar to that shown in panel 100 for receiving connecting members which are secured to a foundation on which the desired structural wall is to be installed. In particular, each structural member in panel 600 which extends to the bottom end 616 of the panel may include a respective inner receiving slot and outer receiving slot, neither of which are shown in FIG. 6, but may be identical in structure to slots 401 and 402 associated with panel 100 shown in FIG. 4.

FIG. 7 provides a side view of a structural door wall panel 700 according to an embodiment of the present invention, with all of the interior structural members in the panel shown in hidden lines. Similar to panel 100 and panel 600, panel 700 includes a shared structural framing member 702 and a top track 704. However, because panel 700 includes a door opening 707, it requires somewhat different framing elements. In particular, panel 700 includes one king stud, which comprises the intermediate structural framing member 703 in this particular panel, and jack studs 709 which support a header 711. It is noted that in the example door panel 700, shared structural framing member 702 serves as a king stud on one side of header 711 due to the width of door opening 707. Panel 700 also includes sheet material covering the structural element similar to sheet 105 and 106 in panel 100, except that the sheet material leaves the door opening 707. Only the near sheet 705 of panel 700 is visible in FIG. 7. As with panel 600, panel 700 incorporates the same receiving structure for interconnecting with other panels according to the invention. In particular, a portion 710 of shared structural framing member 702 protrudes past the sheet material (including sheet 705) at that lateral side 716 of panel 700 to provide a male connector adapted to be received in a female receiver structure of an adjacent panel according to the present invention. Panel 700 also incorporates a female receiver made up of the edges of the sheet material terminating at the lateral side 712 together with the end of top track 704 at that lateral side. This female receiver structure is adapted to receive the protruding portion of the shared structural framing member of an adjacent panel. Also as with panel 100 and 600, panel 700 includes a receiver structure for allowing the panel to be secured to a foundation. This bottom edge receiving structure may include a respective receiving slot similar to receiving slots 401 and 402 shown in FIG. 4 for each framing member (such as members 702, 703, and 709) extending to the bottom end 714 of panel 700.

FIG. 8 shows a shear wall panel 800 identical to shear wall panel 100 but with blocking members 801 included between intermediate structural framing members 803 and between the shared structural framing member 802 and adjacent intermediate structural framing member 803. Panel 800 in FIG. 8 is shown with the near sheet material (corresponding to sheet 105 in FIG. 1 for example) removed to expose the interior framing structure. Blocking members 801 facilitate connecting equipment such as utility boxes, cabinets, and other items to a face of the wall panel. Thus the blocking members 807 may be positioned at standard connecting heights for cabinets, utility boxes, and other items. However, blocking members 801 may be positioned at any desired location in the panel. Because the internal elements of panel 800, including the panel interconnecting and foundation installation features, are shown in connection with FIGS. 1-5, a description of these elements will not be repeated for panel 800.

It should be noted that structural wall panels according to some embodiments of the present invention may not include the sheet material on both sides of the panel as described in connection with the example panels 100, 600, 700, and 800. That is, a completed panel according to the present invention may include sheet material (such as sheet 105 or 106 in FIGS. 2 and 4) on one side. For example, where it is desirable to install panels according to the present invention during wet weather, it may be desirable to leave off sheet material that is sensitive to moisture such as standard gypsum drywall. Thus a structural wall panel may be completed with only the framing members and a relatively weather insensitive sheet material such as certain types of OSB or plywood. In these forms of the invention, the one sheet included in the structure (such as sheet 105 or 106 in FIGS. 2 and 4), together with the end of the top track opposite the end connected to the shared structural framing member, still form a female receiver structure. Also in this one-sheet embodiment, the shared structural framing member still provides a protruding portion that forms a male connector to be received in the female receiver of an adjacent panel.

In another variable within the scope of the present invention, the sheet material on one side of a panel such as panel 100 may be a temporary cover material which may be removed at the jobsite before or after installation of the panel. Also, a temporary sheet material need not cover the entire face of the panel (as sheets 105 and 106 in FIG. 2 do). Rather, a temporary sheet or brace may connect across the structural framing members at a point well above the bottom end of the structural framing members.

FIGS. 9 and 10 show a corner framing member ("corner") 900 which allows two of the panels 100, 600, 700, or 800 to be connected together to form a corner of a building structure. Corner 900 includes an elongated shared structural framing member 902 connected to two additional structural framing members and a length of C-channel material 904. In this particular example corner 900, one of the additional framing members comprises another framing member 905 having the same dimensions as the shared structural framing member 902 while the other additional framing member 906 comprises a somewhat narrower framing member along its short axis. The shared structural framing member 902, and additional framing members 905 and 906 are secured together along one side with straps 907 spaced apart along the length of the example corner 900, and fastened with suitable fasteners 908. The framing members 902, 905, and 906 are secured together on the opposite side by C-channel 904 and additional fasteners 908 driven through a web 910 of the C-channel.

The portion 912 of framing member 902 extending beyond C-channel 904 in direction M in FIG. 10 corresponds to the protruding portion of a shared structural framing member included in a panel according to the present invention, such as protruding portion 110 of panel 100 shown in FIGS. 1-5. Thus the portion 912 of framing member 902 extending beyond C-channel 904 provides a male connector which may be received between the female receiving structure of an adjacent panel. The legs 914 of C-channel 904 form a female receiver for receiving the protruding portion of a shared structural framing member of another adjacent structural wall panel according to the invention (such as protruding portion 110 of panel 100 in FIGS. 1-5 for example). Therefore corner 900 may be used to interconnect two panels of the desired type, 100, 600, 700, or 800 to form a right angle corner of a building structure.

Although the example corner 900 shown in FIGS. 9 and 10 includes structural framing members comprising steel or other suitable metal framing members, one or more of the structural framing members 902, 905, and 906 may comprise lumber or any other suitable material. It is also possible to eliminate one or more of the separate structural framing members 902, 905, and 906 and replace them with a larger framing member of the same shape and equivalent strength as the replaced framing members. Where one or more of the vertical structural framing members 902, 905, and 906 comprise structural lumber, C-channel steel or other suitable material may still be used to form the female receiver of the corner.

Figure 11:
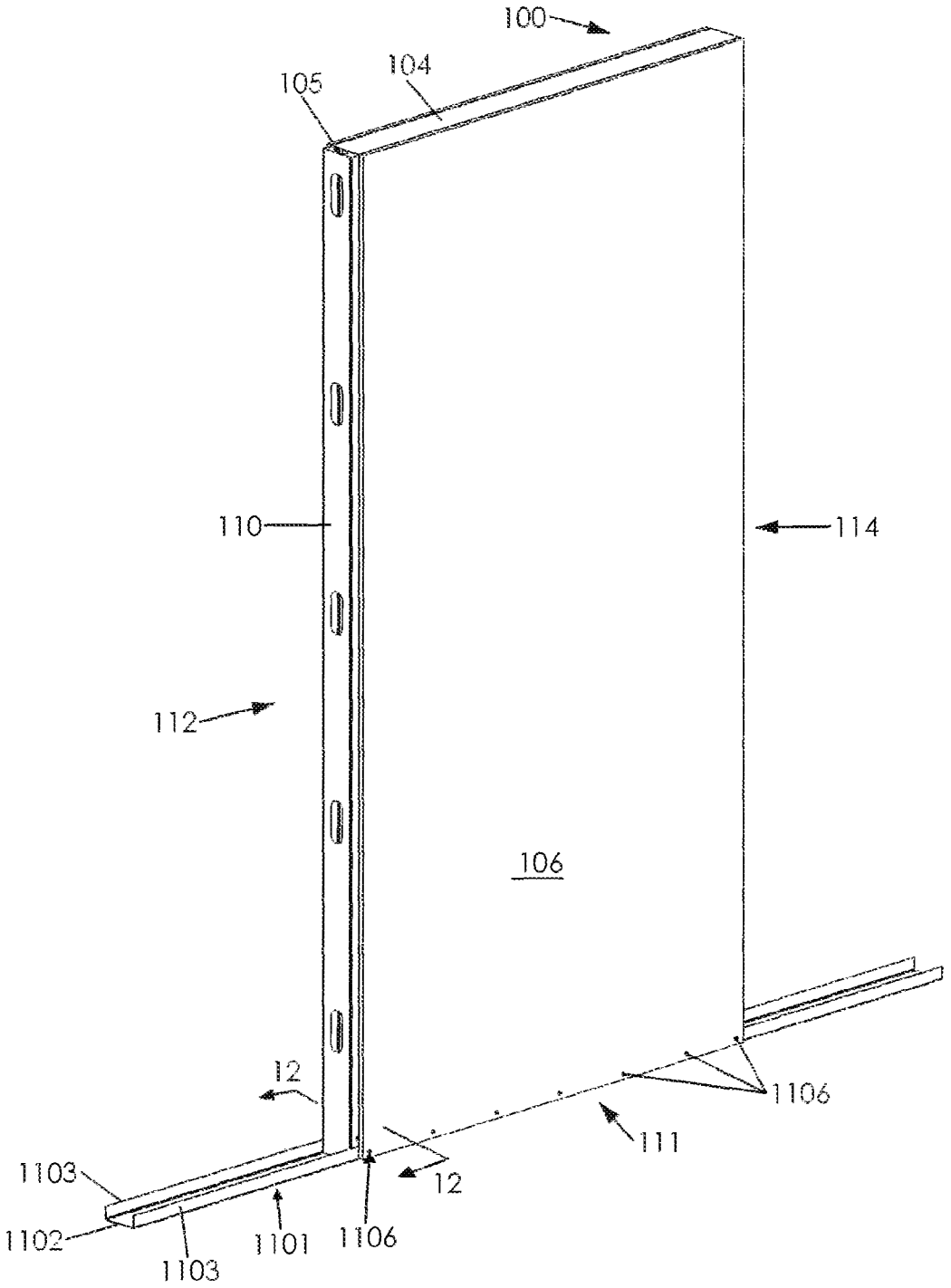
FIG. 11 is a view in perspective an example shear wall panel positioned and partially installed, according to an embodiment of the present invention, on a bottom track which is itself installed on a suitable foundation.
Figure 12:
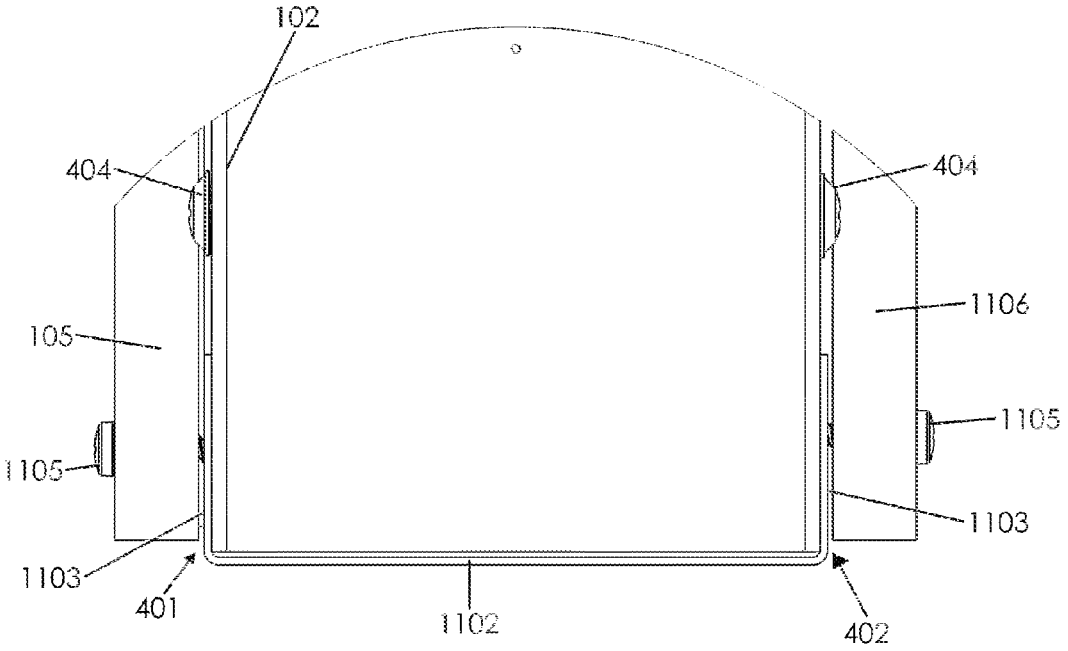
FIG. 12 is an enlarged section view of a bottom end of the shear wall panel installation shown in FIG. 11 taken along line 12-12 in that figure.

A process of installing structural wall panels according to the invention may now be described with reference to FIGS. 11-15 and with periodic reference back to panel 100, panel 600 and corner 900 described in the earlier figures. Referring first to FIG. 11, the installation process requires installing a bottom track 1101 on a foundation which is provided to support the desired structure. Because the foundation comprises simply a plane surface for purposes of describing the present invention, the foundation itself is omitted from the figures. In the particular embodiment shown in FIGS. 11-15, bottom track 1101 comprises a preferably (but not necessarily) continuous length of C-channel material such as C-channel steel having a web 1102 and legs 1103. Bottom track 1101 may be installed on the foundation through any suitable fasting arrangement with web 1102 positioned flush against the foundation surface as shown in FIG. 11, and legs 1103 extending upwardly. Each bottom track 1101 in a given installation defines the position of a wall section for a building and will typically include at least two panel locations, each of which may receive one of the previously described structural wall panels 100, 600, 700, or 800. It should be noted that a "panel location" on a bottom track such as track 1101 need not include any particular structure that distinguishes that location from any other location along the bottom track. As used in this disclosure and the accompanying claims, a "panel location" may simply comprise space along the given bottom track necessary to receive a given panel according the present invention.

FIG. 11 also shows a shear wall panel 100 placed in an installation orientation at a first panel location on bottom track 1101. In this installation orientation, panel 100 extends vertically with the bottom end 111 of panel 100 aligned with elongated bottom track 1101. In the installation orientation of panel 100 shown in FIG. 11, the receiving slot arrangement formed at bottom end 111 of the panel 100 receives the upwardly extending legs 1103 of bottom track 1101. This arrangement is illustrated particularly in the section view of FIG. 12, which shows one leg 1103 of bottom track 1101 extending into the inner slot 401 of panel 100 and the other leg 1103 extending into outer slot 402. In this position, panel 100 may be secured in place on bottom track 1101 by driving a respective fastener 1105 through the sheet material on one side of the panel, through the upwardly extending leg 1103, and into the adjacent structural framing member, in this case shared structural framing member 102. A fastener 1105 driven in this way into each structural framing member (102 and 103 in FIG. 1A) of panel 100 provides a secure connection between the panel and bottom track 1101, and thus between the panel and foundation since the bottom track is secured to the foundation. Additional fasteners 1105 may be driven through the sheet material 105 and 106 and the respective upwardly extending leg 1103 in locations between the structural framing members of the wall panel to further secure the particular sheet material in place along its lower edge. Example connection points for fasteners 1105 are shown at points 1106 in FIG. 11. The right most connection point 1106 in FIG. 11 will receive a fastener 1105 only once another panel 100, 600, 700, or 800, of a corner 900 is received in the receiver structure at that lateral side of the panel as will be described further below. It will be appreciated that although the connection between panel 100 and bottom track 1101 provides a secure connection along the bottom end of the panel, the panel may require temporary bracing against movement at the top of the panel transverse to the longitudinal axis of the bottom track.

Figure 13:
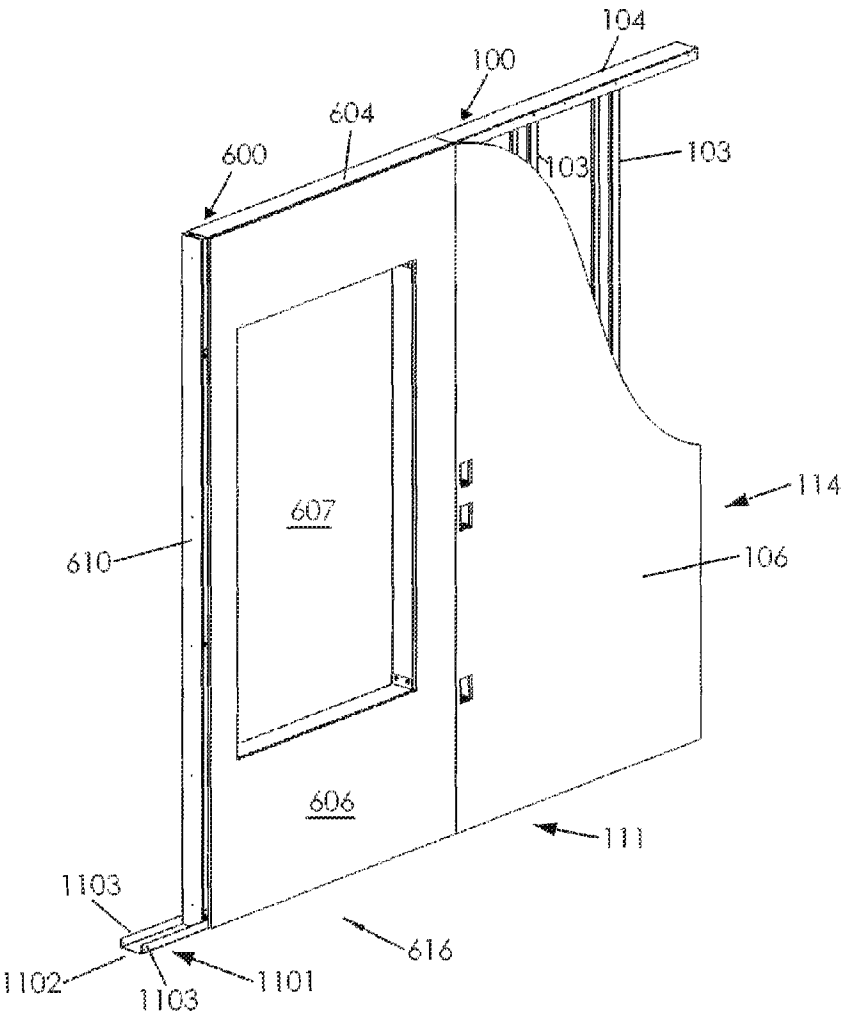
FIG. 13 is a view in perspective of the shear wall panel installation shown in FIG. 11, but showing a window wall panel positioned and partially installed on the bottom track according to an embodiment of the present invention.

FIG. 13 shows bottom track 1101 with panel 100 secured in the installed position at a first panel location and a window wall panel 600 positioned at an adjacent panel location along the bottom track. Panel 600 is connected to bottom track 1101 in the same way that wall panel 100 is connected to the bottom track. In particular, the legs 1103 of bottom track 1101 extend into the respective receiving slots formed at the bottom end of panel 600 and fasteners 1105 may be driven through the sheet material on either side of the wall panel, through the leg 1103 at that side of the wall panel, and then into a respective one of the structural framing members included in the panel.

Figure 13A:
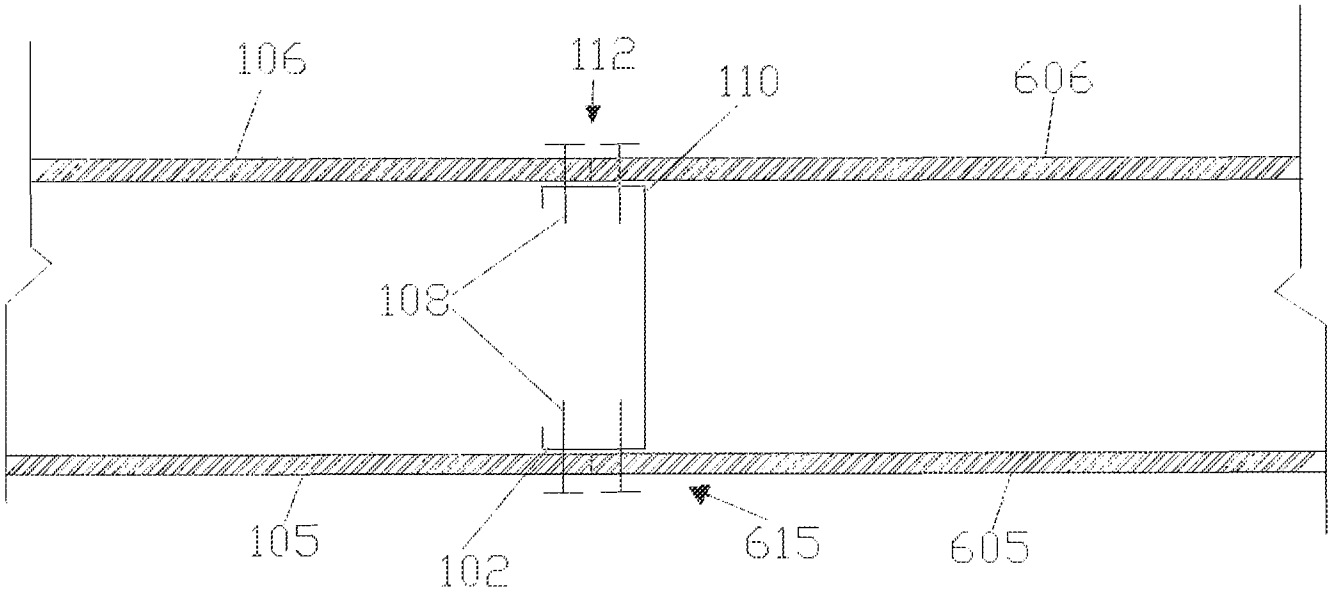
FIG. 13A is a horizontal section view through the shared structural framing member of panel 100 in FIG. 13.
Figure 14:
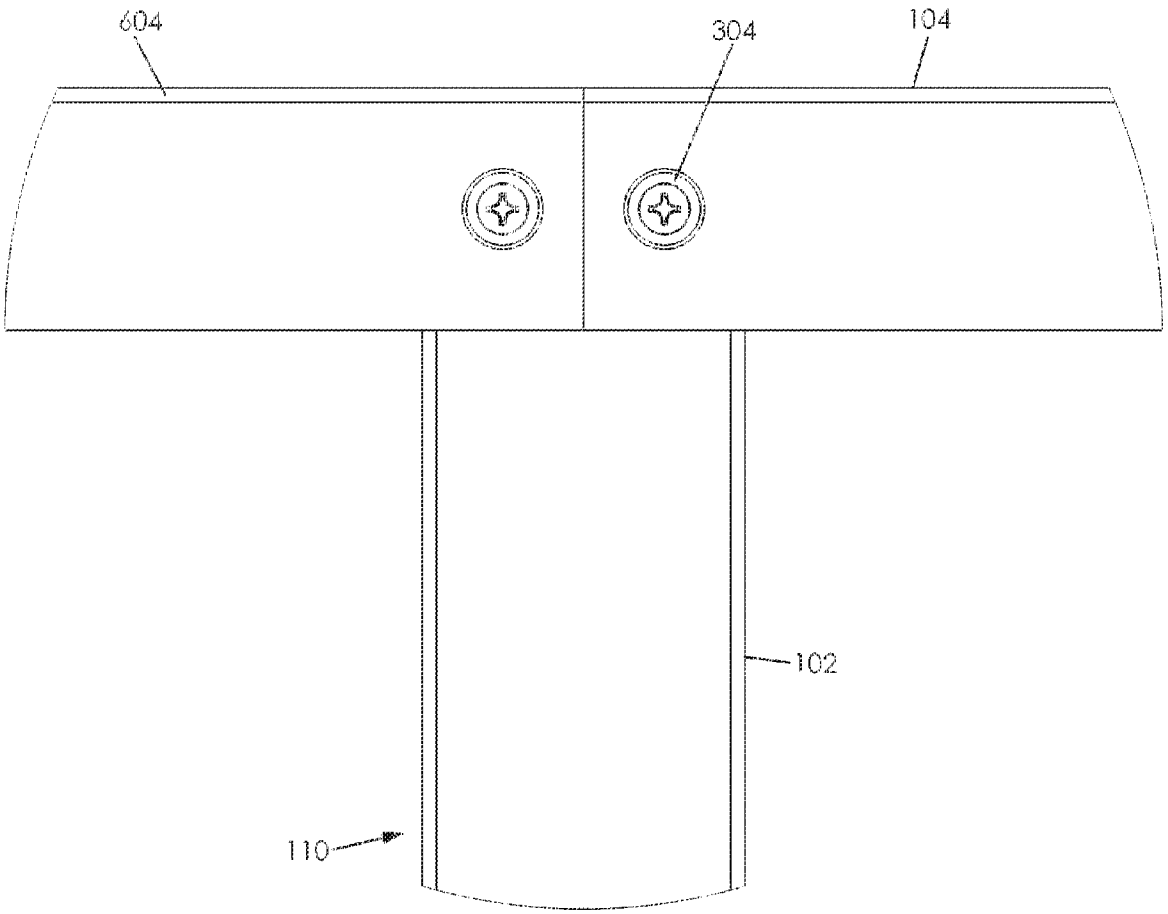
FIG. 14 is an enlarged side view of a top end of the shared structural framing member of panel 100 shown in FIG. 13, but with the sheet material removed to show the connection between panels at the top end of the shared structural framing member.

The interlocking aspect of wall panels according to the present invention is apparent from the section view of FIG. 13A and the enlarged side view of FIG. 14. When adjacent wall panels 100 and 600 are positioned in their respective location as shown in FIG. 13, the male connector of panel 100 is received in the female receiver structure of panel 600 as shown in FIG. 13A. In particular, the protruding portion 110 of shared structural framing member 102 included with panel 100 is received between the sheets 605 and 606 of panel 600. In this installed position, the end of top track 604 of window wall panel 600 also overlaps the protruding portion 110 of shared structural framing member 102 included in panel 100 as shown particularly in FIG. 14. In the embodiments illustrated in the figure, the components of the panels 100 and 600 are proportioned so that top track 604 extends to essentially the midpoint of shared structural framing member 102 and abuts an end of top track 104 included with panel 100. This allows window wall panel 600 to be connected to panel 100 at a top connecting point of top track 604 with a suitable fastener 1401. Also, as shown in the section view of FIG. 13A, sheets 605 and 606 also extend to the midpoint of shared structural framing member 102 of panel 100, and this overlap of sheets 605 and 606 with framing member 102 provides room for driving fasteners through each sheet and into the framing member 102 to secure that edge of the sheets.

Figure 15:
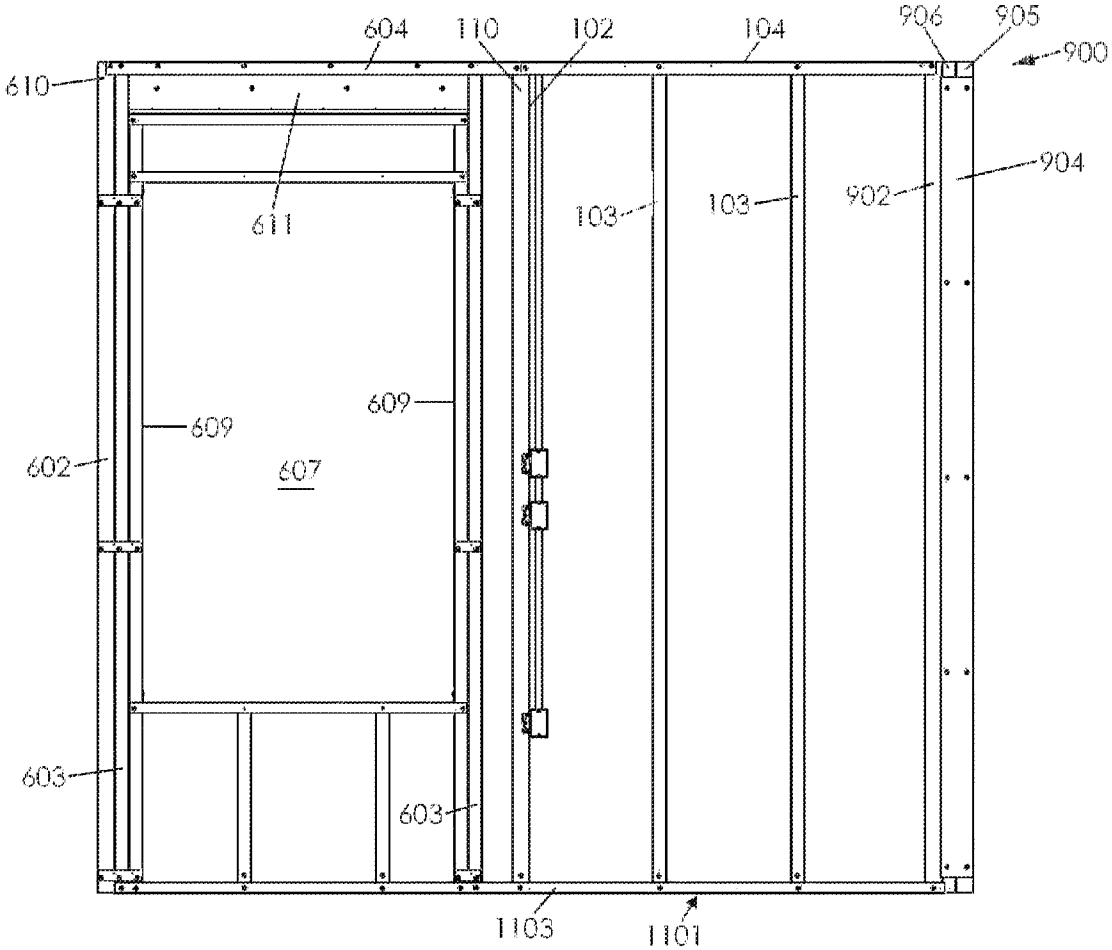
FIG. 15 is an inner side view of the shear wall panel and window wall panel of FIG. 14 shown in a completely installed position together with a corner framing member.

The side view of FIG. 15 shows panel 100 and panel 600 installed on bottom track 1101, but with the sheet material facing the viewer removed to show the interior structure of each panel. FIG. 15 also shows a corner 900 connected on the right hand lateral side of panel 100, opposite the lateral side to which panel 600 is connected. It will be appreciated from FIG. 15 that installing wall panels according to the present invention along a bottom track such as track 1101 structurally completes the wall panels (which were structurally incomplete prior to installation as described above). That is, once installed adjacent to panel 100, the right end of top track 604 included with panel 600 is structurally supported by the shared structural framing member 102 of wall panel 100. Similarly, the right end of top track 104 for wall panel 100 is structurally supported by shared structural framing member 902 of corner 900. Furthermore, securing the bottom end of each structural framing member of each panel 100 and 600 at the respective connecting points 1501 to bottom track 1101 secures the lower end of the respective structural framing member and thus helps hold each structural framing member in the desired vertical orientation in the completed structural wall. Also, comparing the connection points 1601 for panel 100 to the connection points 1601 for panel 600, it will be appreciated that there are more connection points for window wall panel 600 due to the larger number of framing elements which extend to the bottom end of the panel, namely, the two cripple studs 614, two jack studs 609, and two king studs 603, in addition to the shared structural framing member 602.

Structural wall panels according to the present invention provide benefits in terms of cost savings during installation, and in terms of efficiencies and quality controls available through prefabrication away from the construction site. Wall panels according to the invention also create efficiencies through the ability to recover the panels intact from one building structure and then reuse the recovered panel in a completely different building structure at the same or different location. Once a panel such as panel 100, 600, 700, or 800 is installed on a bottom track as described above in connection with FIGS. 13 and 13A, the panel may be removed substantially intact by simply locating and removing the fasteners along the bottom side of the panel and along each lateral side. Removing the fasteners along each lateral side of a panel disconnects that panel from the adjacent panels (or perhaps an adjacent corner 900 if the panel is connected to such a corner). Removing the fasteners along the bottom side of the panel disconnects the panel from the bottom track (1101 in FIG. 13). With the bottom side and lateral side fasteners removed, the now disconnected panel may simply be lifted off the bottom track and moved to storage for later use or moved to a different location for installation in as part of a different framed structure. Installation in the new location may be accomplished in the process described above in connection with FIGS. 11-15. The only difference in a reinstallation of a previously installed panel as compared to a previous installation is that the reinstallation may use slightly larger diameter fasteners to ensure a secure connection at each connection point. Of course since the wall panels according to the present invention are structural panels which may carry a load in a given installation, it will be necessary to remove that load (roof structure load or upper story load) from a given panel prior to removing any significant number of the fasteners holding that panel.

Figure 16:
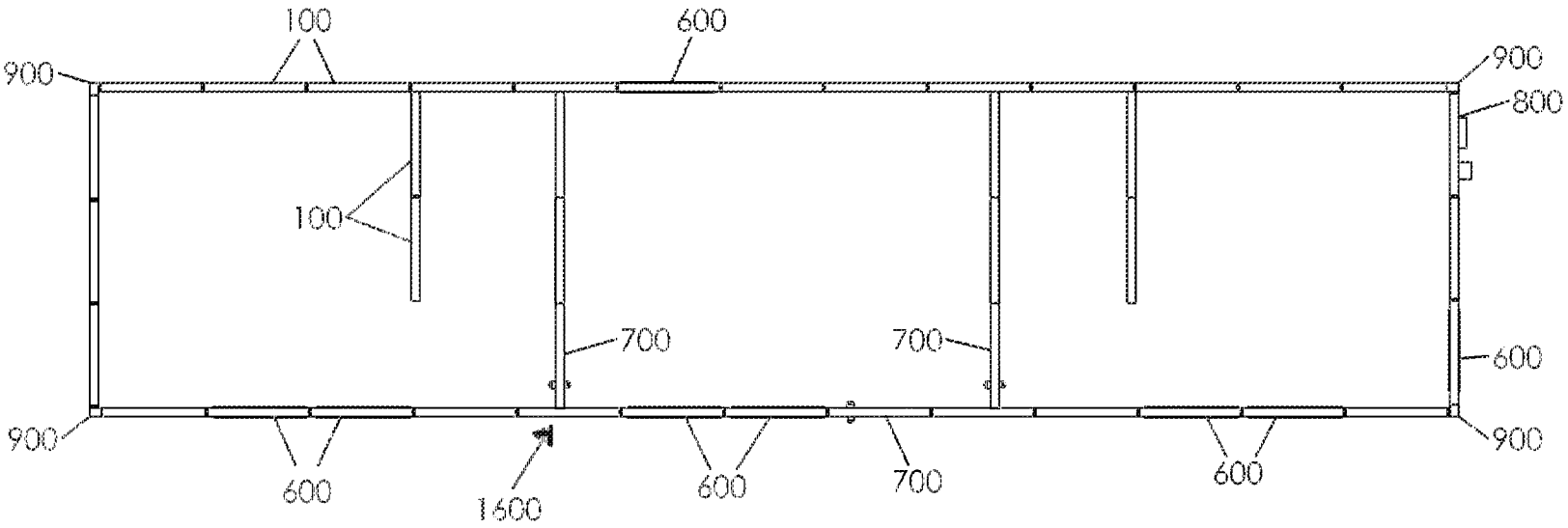
FIG. 16 is a plan view of an installation of structural wall panels according to an embodiment of the present invention.
Figure 17:
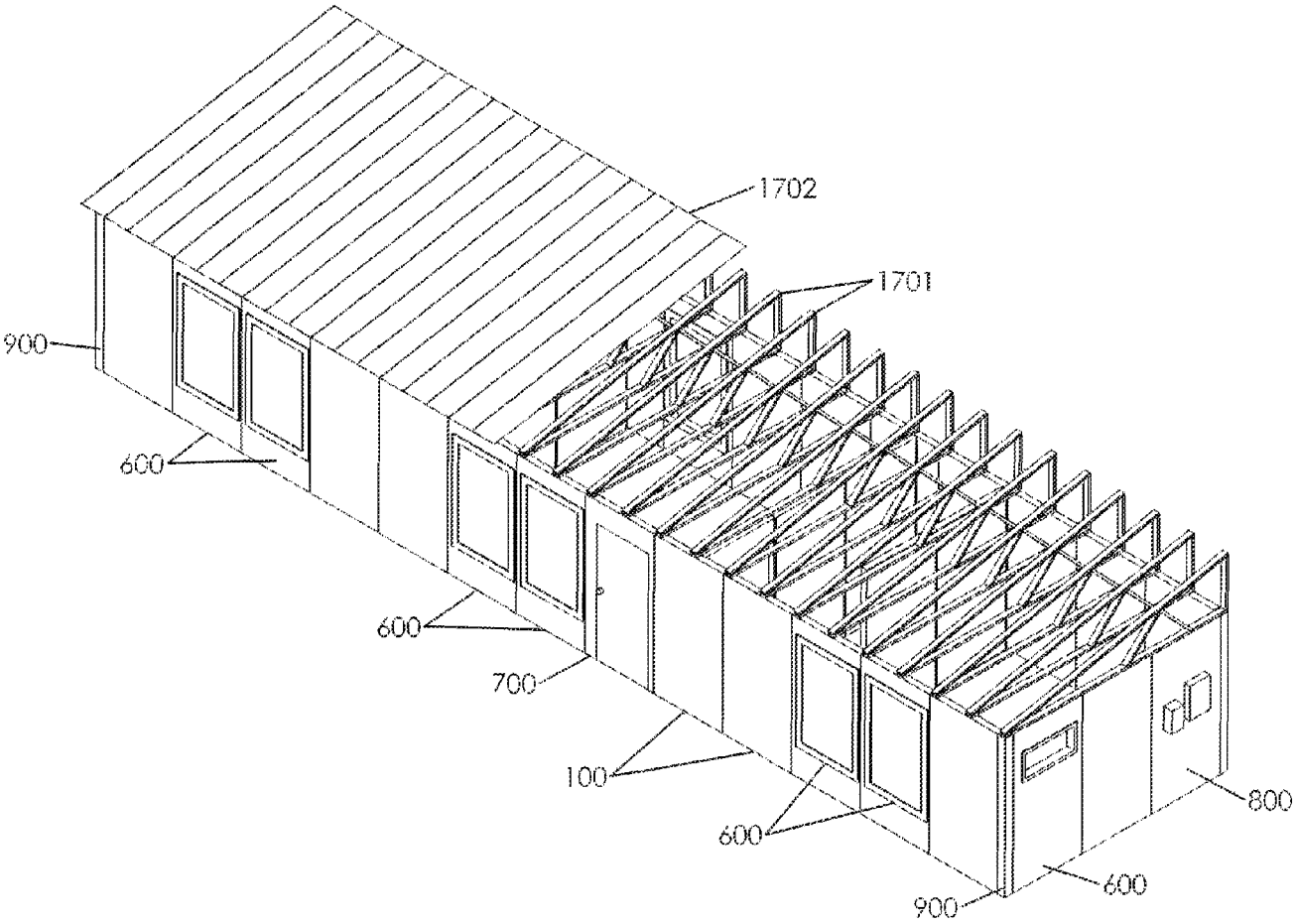
FIG. 17 is a view in perspective of the arrangement of structural wall panels shown in FIG. 16 showing roof joists and roofing panels according to one aspect of the present invention.

The different types of wall panels, that is, shear wall panel 100, window wall panel 600, door wall panel 700, and blocking wall panel 800, may be combined together with corners 900 to form any number of rectangular-shaped building wall frames. One example of such a building wall frame 1600 is shown in FIG. 16. This particular example includes four corners 900, a number of shear wall panels 100, three door wall panels 700, and ten window wall panels 600. All of these wall panels are all installed on a suitable bottom track as described in FIGS. 11-15 secured to a suitable foundation to form a framed structure which may then receive roof framing members 1701 and roofing panels 1702 as shown in FIG. 17. It will be appreciated from FIGS. 16 and 17 that wall panels according to the present invention may be formed in standard sizes, for example, 4 feet wide and 8 feet tall to facilitate connection in the illustrated rectangular arrangements. The invention is not limited to any particular dimensions for the wall panels however, the wall panels for a given system should be sized consistently to ensure the panels may be interconnected to form walls of equal length to facilitate rectangular framed structures.

It will be noted in FIG. 16 that a building structure according to the present invention may include walls configured in a T shape. To form a wall corresponding to the leg of a T shape, a suitable structural framing member such as a shared framing member 102 shown in FIG. 2, may be secured in a vertical orientation with suitable fasteners to the point at which that wall is to extend from the other wall. Alternatively, a length of C-channel may be connected in a vertical orientation to the point from which the T-wall is to extend to provide a female receiver similar to that provided by the C-channel used in corner 900 shown in FIG. 10.

In order to provide additional strength along the top of the connected walls as shown in FIG. 16, a length of suitable reinforcing material may be connected to the top track of each panel so as to span multiple panels. Such a reinforcing material may comprise a length of flat steel, lumber, or any other suitable material and may span the entire wall section.

Figure 18:
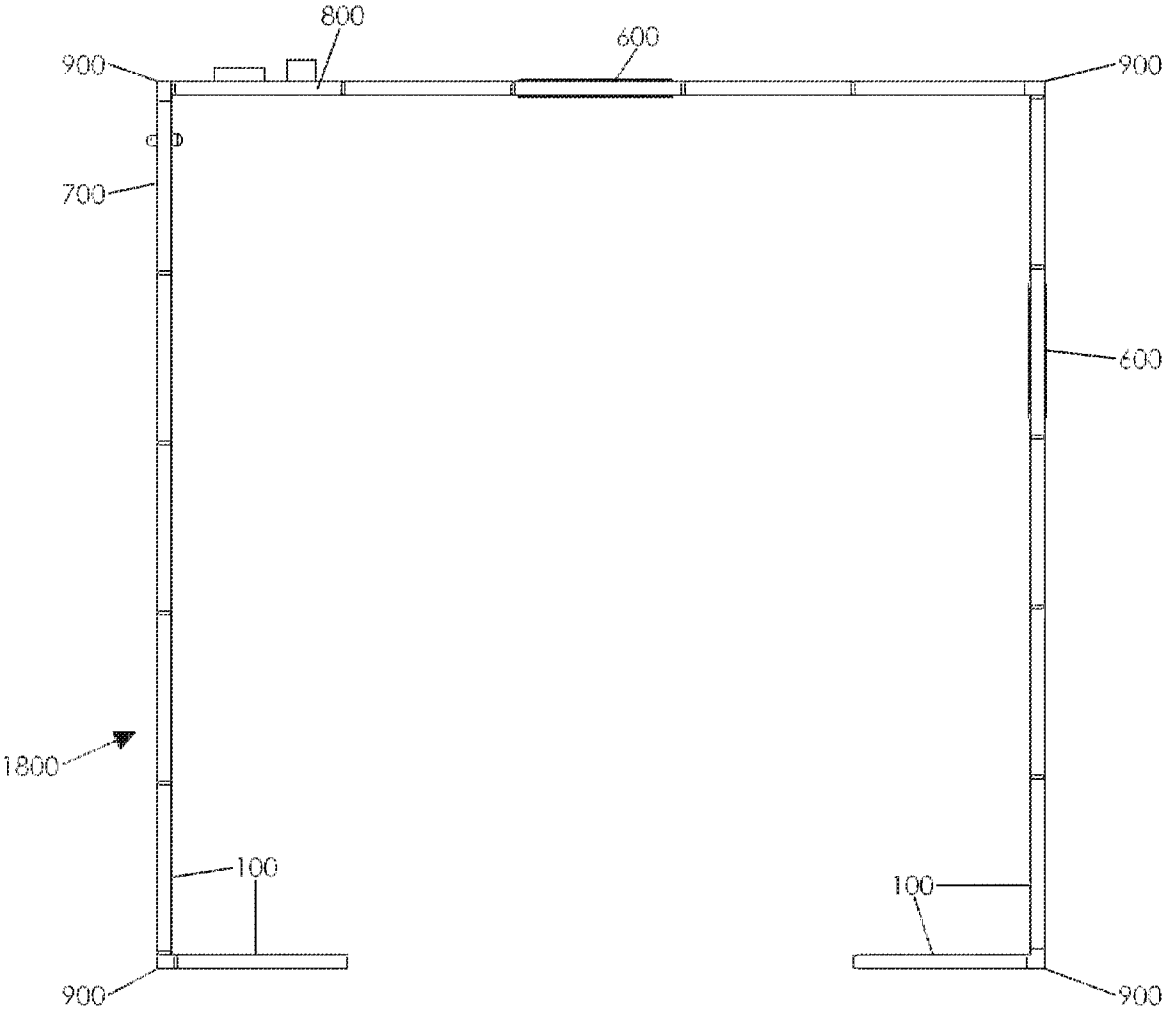
FIG. 18 is a plan view of another installation of structural wall panels according to an embodiment of the present invention.

FIG. 18 illustrates an example of a garage structure produced from wall panels according to the present invention. Garage structure 1800 is made up of a number of shear wall panels 100, four corners 900, one door wall panel 700, two window wall panels 600, and a blocked shear wall panel 800 which facilitates the installation of utility boxes 1801.

Figure 19:
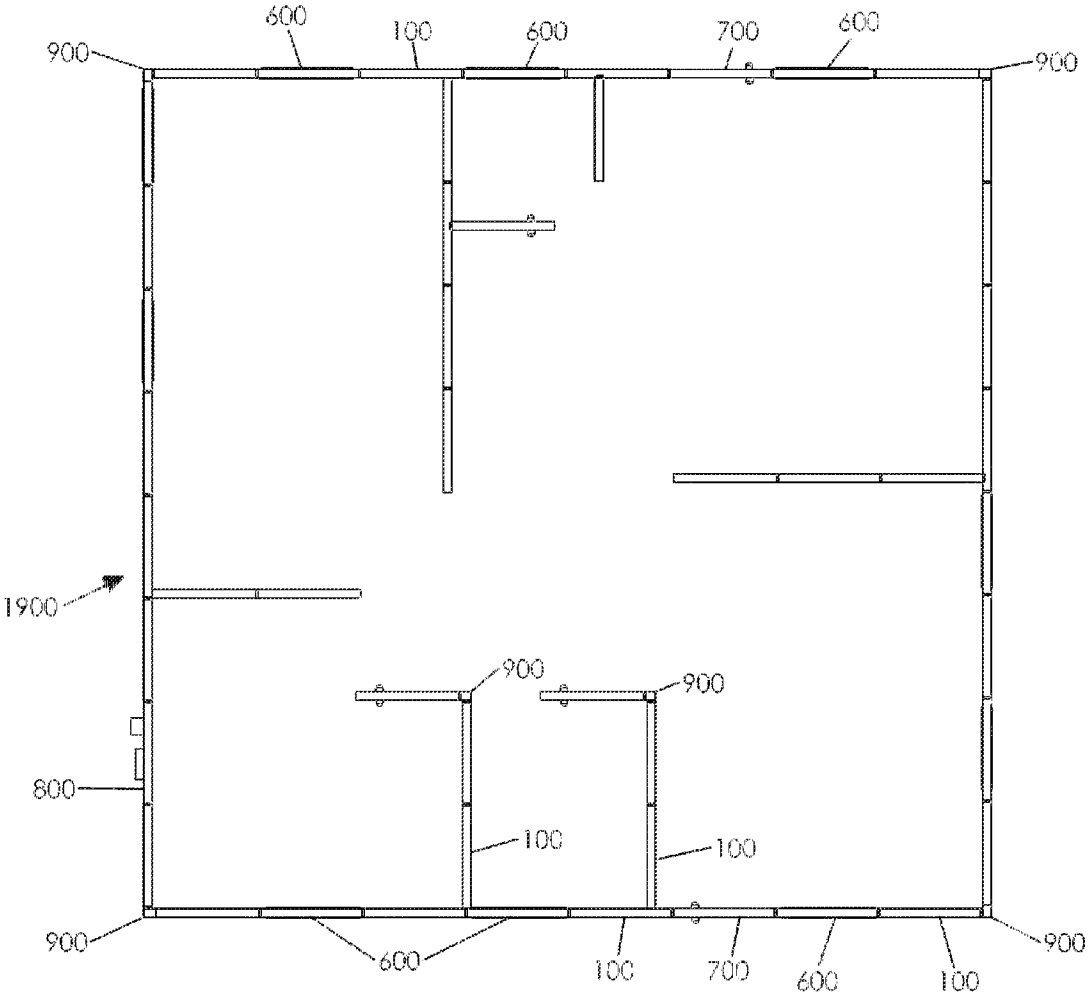
FIG. 19 is a plan view of another installation of structural wall panels according to an embodiment of the present invention.

FIG. 19 shows another example of a structure 1900 produced from wall panels according to the present invention. Example structure 1900 includes a number of shear wall panels 100, a blocked shear wall panel 800, a number of window wall panels 600, and a number of door wall panels 700.

Figure 20:
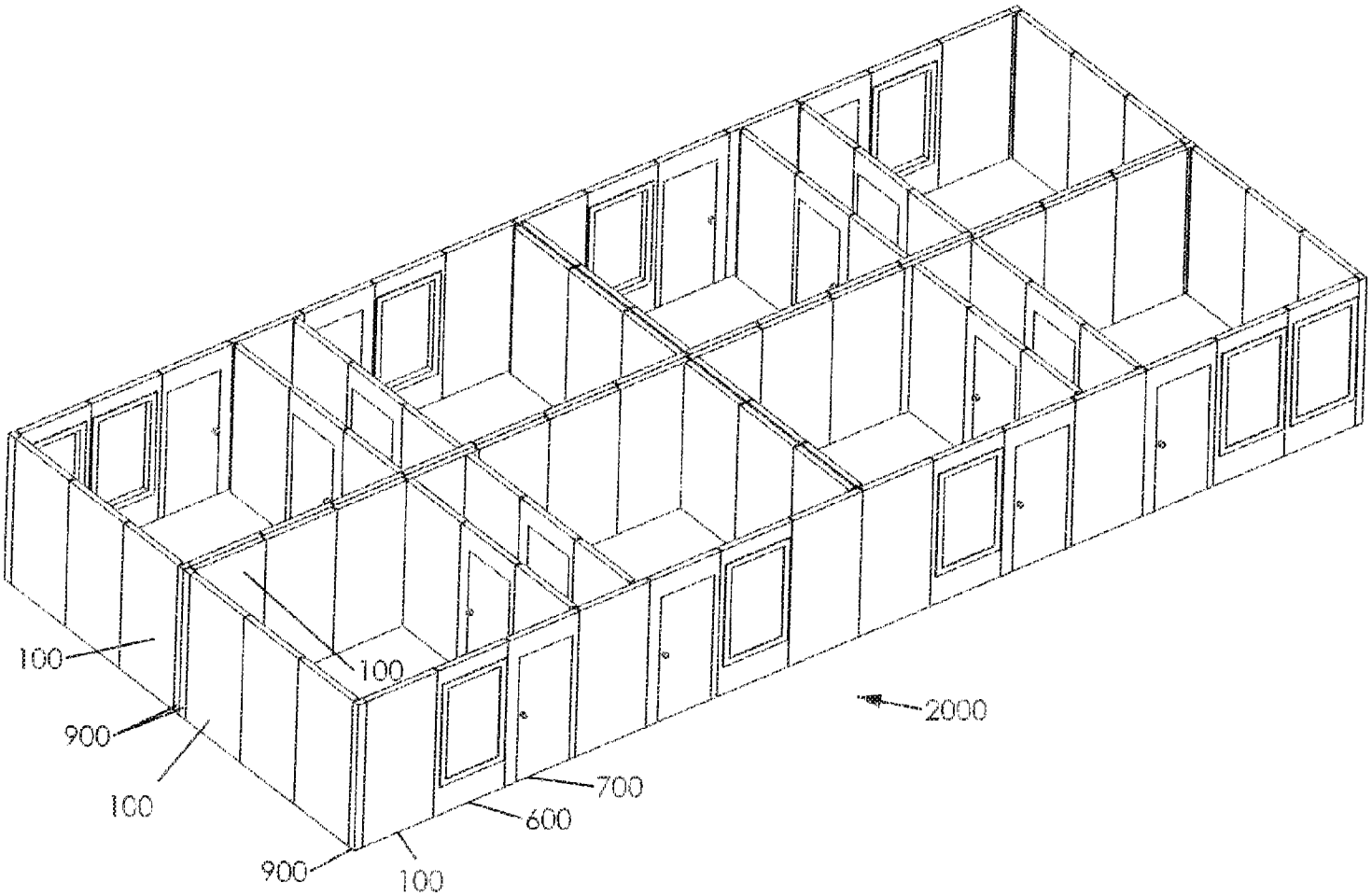
FIG. 20 is a view in perspective showing another installation of structural wall panels according to an embodiment of the invention.

FIG. 20 shows yet another example of a structure 2000 which may be formed from wall panels according to the invention. It will be noted from FIG. 20 that some of the wall panels used for the interior walls are connected back-to-back with other wall panels. This panel arrangement may be used to provide improved sound dampening between the interior rooms and may also be used to better support roof or second floor framing which may be placed on top of the structural wall panels.

It should be noted that the reusable aspect of the panels 100, 600, 700, and 800, and corners 900 according to the invention allows panels and corners from any one of the example building structures shown in FIGS. 16-20 to be disconnected and removed from that structure and then reused in any one of the other example building structures. For example, the building structure shown in FIGS. 16 and 17 may comprise a temporary building such as a job site construction office or temporary workers' quarters. Once the building is no longer needed at its temporary location, the roofing panels and roofing trusses may be removed to remove the load on corner 900 and on wall panels 100, 600, 700, and 800, and then the wall panels may and corner may be disconnected from each other and from the bottom tracks (not shown in those figures). The disconnected panels and corner may then be lifted from the bottom track and transported to the location for the building shown in FIG. 20 for example, and installed in one of the panel locations in that building. The panels and corners recovered from the building shown in FIGS. 16 and 17 are installed on a respective bottom track (not shown in FIG. 20) used in the building shown in FIG. 20 in the same fashion as any of the other panels and corners used in that structure aside from perhaps using slightly larger diameter fasteners to connect the reused panels and corner. Because the structural framing members in the panels 100, 600, 700, and 800, and corner 900 may all be selected to meet building code requirements for permanent buildings, and because these components are all interconnected according to the invention in a way that allows compliance with building code requirements for permanent structures, the panels and corners may be removed from the first structure (which is a temporary structure in this example) and reused in the second structure which may be a permanent structure for example (or another temporary structure).

FIGS. 21 and 22 may be used to describe different bottom tracks which may be used with wall panels according to the present invention, such as wall panels similar to panels 100, 600, 700, and 800 discussed above. FIGS. 21 and 22 show a portion of a concrete foundation 2100 which is provided to support the desired framed wall structure. Bottom track 2101 in FIGS. 21 and 22 includes a bottom or sole plate 2102 which may be suitable treated dimensional lumber or other suitable material, and C-channel material 2104. C-channel 2104 includes a web 2105 positioned flush against the top surface of sole plate 2102 and legs 2107 extending upwardly. In the example of FIG. 21, sole plate 2102 and C-channel 2104 are both secured to foundation 2100 through J-bolts 2103 which are fixed in the foundation concrete. C-channel 2104 may additionally or alternatively be connected to sole plate 2101 with suitable fasteners (not shown) driven through web 2105 into the sole plate material.

C-channel 2104 in the example of FIGS. 21 and 22 performs the same function as the C-channel making up bottom track 1101 shown in FIG. 11. Referring particularly to FIG. 22, a wall panel 100*a* may be placed on bottom track 2101 in an installation position in which each leg 2107 extends upwardly into a respective slot 401*a* and 402*a* formed between framing member 103*a* and the respective sheet 105*a* or 106*a*. In this position, a suitable fastener 2108 may be driven through the sheet material on a given side and corresponding leg 2107 and into framing member 103*a* to secure the panel to bottom track 2101. It should be noted that the width of slots 401*a* and 402*a* are somewhat exaggerated in the diagrammatic view of FIG. 22 as are the gaps between elements (between sole plate 2102 and foundation 2100, for example) in the diagrammatic representation of FIG. 21.

FIG. 22 also shows an arrangement of additional strap members 2110 which may be used to secure panel 100*a* to foundation 2100 in addition to or in lieu of C-channel 2104. In the form shown in FIG. 22, strap members 2110 comprise thin (16 gauge, or other gauge depending upon the load requirements for the installation) and narrow (1.25 inch wide) bands of metal or other suitable material with one end embedded in the foundation concrete and the other end extending upwardly where it may extend into a respective one of the slots 401*a* or 402*a*. In this position shown in FIG. 22, a fastener such as fastener 2108 or a separate fastener 2112 may be installed in the positions shown to secure the panel to foundation 2100. It should be appreciated that straps such as 2110 may be used also with bottom track 1101 described above or may be used in lieu of such a C-channel bottom track.

It will be noted with reference to FIG. 22, that where a sole plate 2102 is used in the bottom track, the framing members (such as framing member 103*a*) of the installed wall panel 100*a* do not extend all the way down to the level of the foundation. This compares with the installed position shown in FIG. 12 where the framing member 102 is spaced from the foundation by only the thickness of web 301. In view of the position of the bottom ends of the framing members relative to the foundation where a sole plate is used, the lower ends of the sheet material 105*a* and 106*a* must extend further past the lower ends of the framing members in order to provide an acceptable gap between the sheet material and the foundation surface.

In another alternative arrangement for a bottom track useful to secure wall panels according to the present invention, a number of C-shaped straps may be placed with a web part under a sole plate and with legs of the C-shaped straps extending upwardly on either side of the sole plate, generally in the position shown in FIG. 22 for straps 2110. In this position a suitable fastener may be driven through the sheet material, the strap leg, and into the framing member to secure the panel to the foundation.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A panel for use in producing framed walls in building construction, the panel being in an uninstalled condition in which it does not form a framed wall, the panel including:

(a) a number of framing members, the framing members consisting of (i) only one elongated shared structural framing member, the elongated shared structural framing member having a first face defining a first lateral side of the panel and (ii) one or more elongated intermediate structural framing members, the one or more elongated intermediate structural framing members extending substantially parallel to the shared structural framing member and being positioned in the panel at a respective location spaced apart from the first lateral side of the panel and a second lateral side of the panel;

(b) an elongated track including an elongated web part and two track legs extending perpendicular to the web part so as to form a C-shaped cross section, the elongated track being connected to the shared structural framing member and to the one or more intermediate structural framing members with the web part abutting an end of the shared structural framing member and a respective end of the one or more intermediate structural framing members with each track leg extending along a portion of the length of the shared structural framing member and the one or more intermediate structural framing members, a first end of the elongated track partially overlapping the end of the shared structural framing member so as to leave a part of the shared structural framing member exposed beyond the first end of the elongated track, and a second end of the elongated track terminating at the second lateral side of the panel;

(c) wherein the first end of the elongated track extends a first distance beyond a respective one of the one or more elongated intermediate structural framing members which is nearest to the first end of the elongated track;

(d) wherein the part of the shared structural framing member exposed beyond the first end of the elongated track provides a male connector to be received in a second end of an elongated track of an adjacent panel; and (e) wherein the second end of the elongated track extends the first distance beyond a respective one of the one or more elongated intermediate structural framing members which is nearest to the second end of the elongated track.

2. The panel of claim 1 further including a length of rigid material spanning the distance between the shared structural framing member and the one or more intermediate structural framing members, the length of rigid material interacting with the shared structural framing member and the one or more intermediate structural framing members so as to retain the one or more intermediate structural framing members parallel to the shared structural framing member.

3. The panel of claim 2 wherein the length of rigid material comprises a first sheet of material secured with a number of first sheet fasteners to the shared structural framing member and to the one or more intermediate structural framing members so as to form a first face of the panel.

4. The panel of claim 3 further including a second sheet secured with a number of second sheet fasteners to the shared structural framing member and to the one or more intermediate structural framing members so as to form a second face of the panel, the first sheet and second sheet each including a respective first edge aligned with the track first end and a respective second edge aligned with the track second end at the second lateral side of the panel, the alignment of the respective first edge with the track first end leaving a portion of the shared structural framing member protruding past the track first end at that end of the shared structural framing member and protruding past the respective first edge of the first and second sheet along the length of the shared structural framing member.

5. The panel of claim 1 wherein the shared structural framing member has a width dimension in a plane of the panel that is greater than a width dimension of one or more of the one or more intermediate structural framing members in the plane of the panel.

6. The panel of claim 1 further including a header lying in a plane of the panel and being supported by two jack studs, and wherein the one or more intermediate structural framing members include a respective king stud at each end of the header.

7. A panel for use in producing framed walls in building construction, the panel being in an uninstalled condition in which it is not connected to a building foundation to form a framed wall, the panel including:

(a) a number of framing members, the framing members consisting of (i) only one elongated shared structural framing member, the elongated shared structural framing member having a first face defining a first lateral side of the panel, and (ii) one or more elongated intermediate structural framing members extending substantially parallel to the shared structural framing member;

(b) an elongated track connected to a respective end of the one or more intermediate structural framing members and the shared structural framing member and including a track first end and a track second end, the track first end located at an intermediate point of the end of the shared structural framing member so as to leave a part of the shared structural framing member exposed beyond the track first end, and the track second end terminating at a second lateral side of the panel, the part of the shared structural framing member exposed beyond the track first end providing a male connector to be received in a track second end of an adjacent panel;

(c) wherein the track first end extends a first distance beyond a respective one of the one or more elongated intermediate structural framing members which is nearest to the track first end; and (d) wherein the track second end extends the first distance beyond a respective one of the one or more elongated intermediate structural framing members which is nearest to the track second end.

8. The panel of claim 7 further including a length of rigid material spanning the distance between the shared structural framing member and the one or more intermediate structural framing members, the length of rigid material interacting with the shared structural framing member and the one or more intermediate structural framing members so as to retain the one or more intermediate structural framing members parallel to the shared structural framing member.

9. The panel of claim 8 wherein the length of rigid material comprises a first sheet secured with a number of first sheet fasteners to the shared structural framing member and to the one or more intermediate structural framing members so as to form a first face of the panel, the first sheet including a first edge aligned in an intermediate position along the length of the shared structural framing member and a second edge aligned with the track second end at the second lateral side of the panel, the position of the first edge of the first sheet relative to the shared structural framing member leaving a portion of the shared structural framing member protruding from the first edge of the first sheet along the length of the shared structural framing member.

10. The panel of claim 9 further including a second sheet secured with a number of second sheet fasteners to the shared structural framing member and to each intermediate structural framing member so as to form a second face of the panel, the second sheet including a first edge aligned in a respective intermediate position along the length of the shared structural framing member and a second edge aligned with the track second end at the second lateral side of the panel.

11. The panel of claim 7 wherein the shared structural framing member has a width dimension in a plane of the panel that is greater than a width dimension of one or more of the one or more intermediate structural framing members in the plane of the panel.

12. The panel of claim 7 further including a header lying in a plane of the panel and being supported by two jack studs, and wherein the one or more intermediate structural framing members include a respective king stud at each end of the header.

* * * * *